US005587276A

United States Patent [19]

Katoh

[11] Patent Number: 5,587,276

[45] Date of Patent: Dec. 24, 1996

[54] IMAGE FORMATION METHOD

[75] Inventor: Kazunobu Katoh, Kanagawa, Japan

[73] Assignee: Fuji Photo Film Co., Ltd., Kanagawa, Japan

[21] Appl. No.: 590,195

[22] Filed: Jan. 23, 1996

[30] Foreign Application Priority Data

Jan. 23, 1995 [JP] Japan ..... 7-008094

[51] Int. Cl.[6] ..... G03C 5/29

[52] U.S. Cl. ..... 430/440; 430/265; 430/441; 430/480; 430/483; 430/531; 430/963

[58] Field of Search ..... 430/265, 440, 430/441, 480, 483, 531, 963

[56] References Cited

U.S. PATENT DOCUMENTS 5,188,930 2/1993 Funaki et al. ..... 430/531

5,230,994 7/1993 Yamada et al. ..... 430/963

5,264,323 11/1993 Purol et al. ..... 430/440

*Primary Examiner*—Hoa Van Le

*Attorney, Agent, or Firm*—Sughrue, Mion, Zinn, Macpeak & Seas

[57] ABSTRACT

A method for forming a silver halide photographic image comprising developing a silver halide photographic material with a developing solution containing an ascorbic acid developing agent, substantially free from hydroquinone and having a pH of 8.5 to 11.0, the silver halide photographic material comprising a support formed of a syndiotactic styrenic polymer and a silver halide emulsion layer formed on at least one surface thereof, the emulsion layer or another hydrophilic colloidal layer containing a hydrazine derivative, and the total amount of gelatin of the emulsion layer being 2.5 g/m$^2$ or less, thereby reducing black spot fog and improving dimensional stability of the photographic material.

3 Claims, No Drawings

IMAGE FORMATION METHOD

FIELD OF THE INVENTION

The present invention relates to image formation method using a silver halide photographic material for platemaking.

BACKGROUND OF THE INVENTION

Methods for forming hard images by use of hydrazine derivatives are well known in the art. In particular, methods for forming high contrast images utilizing infectious development with hydrazine derivatives are preferably used for output photographic materials for scanners using laser beams or image setters, because of their good gradation reproducibility, high Dmax and clear dots at edges.

Such image formation methods are described in JP-A-1-179939 (the term "JP-A" as used herein means an "unexamined published Japanese patent application"), JP-A-1-179940, JP-A-6-27571, U.S. Pat. Nos. 4,998,604 and 4,994,365.

A silver halide photographic material generally has a layer in which a hydrophilic colloid such as gelatin is used as a binder, on at least one side of a support. Such a hydrophilic colloidal layer has the disadvantage that it easily expands and contracts according to changes in humidity and temperature.

Changes in the dimension of the photographic materials caused by expansion and contraction of the hydrophilic colloidal layers result in very serious defects for photographic materials for platemaking in which reproduction of halftone dot images or precise line images is required for multicolor print.

In particular, with recent increased high precision in print, a further improvement in dimensional stability of the photographic materials has been intensely desired. Plastic supports of the silver halide photographic materials used in photomechanical processes are generally formed of polyesters represented by polyethylene terephthalate (hereinafter referred to as "PET"). PET films are characterized by excellent dimensional stability, mechanical strength and productivity, and have hitherto been widely used.

However, even when the PET films are used, the required dimensional stability can not be satisfied.

U.S. Pat. No. 3,201,250 discloses a technique in which the ratio of the thickness of hydrophilic colloidal layer(s) to that of a support is specified to obtain a photographic material having less change in dimension, namely excellent in dimensional stability. Further, a technique of adding a polymer latex to a hydrophilic colloidal layer is described in JP-B-39-4272 (the term "JP-B" used herein means an "examined Japanese patent publication"), JP-B-39-17702, JP-B-43-13482, JP-B-45-5331, U.S. Pat. Nos. 2,376,005, 2,763,625, 2,772,166, 2,852,386, 2,853,457, 3,397,988, 3,411,911 and 3,411,912. The evidence of these techniques is described in J. Q. Umberger, *Phot. Sci. and Eng.*, pages 69–73 (1957).

Further, a technique of coating a polyester film support with a vinylidene chloride copolymer is described in U.S. Pat. Nos. 4,645,731, 4,933,267 and 4,954,430. Furthermore, a technique of drying a support at low humidity and subjecting it to heat treatment is described in JP-A-1-229240 and JP-A-1-229244.

However, even when the prior-art techniques for improving dimensional stability are applied to the PET films, they are insufficient for the requirements in high precision print yet.

Syndiotactic styrenic polymer (hereinafter referred to as "SPS") films having a low coefficient of moisture expansion as compared with the PET films are disclosed in JP-A-3-131843. Silver halide photographic materials for photomechanical processes in which the SPS film is used as a support are more improved in register adjustment of a plurality of plates in multicolor print than the photographic materials having the PET film as a support, but they are insufficient for high precision print yet.

When the SPS film is used as the support and the amount of gelatin contained in a photosensitive emulsion layer and other hydrophilic colloidal layers is decreased to intend to improve the dimensional stability, an unexpected problem is encountered in the case of hydrazine high contrast photographic materials.

It is a significant increase in sand-like black spot fog. In particular, when the development time is more prolonged than the standard to thicken halftone dots, which is usually called forced development, or when the amount of sulfites is decreased by deterioration of a developing solution, such a fog is further increased.

It has therefore been intensely desired to provide a silver halide photographic material which exhibits little fog and is excellent in dimensional stability.

SUMMARY OF THE INVENTION

An object of the present invention is to provide an image formation method using a silver halide photographic material for a photomechanical process which is excellent in dimensional stability.

According to the present invention, there is provided a method for forming a silver halide photographic image comprising developing a silver halide photographic material with a developing solution containing an ascorbic acid developing agent, substantially free from hydroquinone and having a pH of 8.5 to 11.0, the silver halide photographic material comprising a support formed of a syndiotactic styrenic polymer and a silver halide emulsion layer formed on at least one surface thereof, the emulsion layer or another hydrophilic colloidal layer containing a hydrazine derivative, and the total amount of gelatin on the emulsion layer side of the support being 2.5 g/m$^2$ or less.

DETAILED DESCRIPTION OF THE INVENTION

First, the SPS film used in the present invention is described.

The syndiotactic styrenic polymer is a polymer having a steric structure in which phenyl groups or derivatives thereof, side chains, are positioned alternately in the opposite directions along a main chain formed by carbon-carbon bonds, and its stereoregularity (tacticity) is generally determined by the nuclear magnetic resonance method ($^{13}$C-NMR method) by use of isotopic carbon atoms, which is excellent in accuracy. The tacticity measured by the $^{13}$C-NMR method can be indicated by the existence ratio of a plurality of continuous constituent units, for example, the dyad convention for 2 units, the triad convention for 3 units, and the pentad convention for 5 units. The syndiotactic styrenic polymers used in the present invention usually have a tacticity of 75% or more, preferably 85% or more in the racemic dyad, and a tacticity of 30% or more, preferably 50% or more in the racemic pentad. Specifically, the syndiotactic styrenic polymers refer to stereoregular polystyrene, poly(alkylstyrenes), poly(halogenated styrenes), poly- (halogenated alkylstyrenes), poly(alkoxystyrenes), poly(vinylbenzoates), hydrogenated polymers thereof, mixtures thereof or copolymers containing structural units thereof.

The poly(alkylstyrenes) include poly(methylstyrene), poly(ethylstyrene), poly(propylstyrene), poly(butylstyrene), poly(phenylstyrene), poly(vinylnaphthalene), poly(vinylstyrene) and poly(acenaphthylene). The poly(halogenated styrenes) include poly(chlorostyrene), poly(bromostyrene) and poly(fluorostyrene). The poly(alkoxystyrenes) include poly(methoxystyrene) and poly(ethoxystyrene).

Comonomer components of the copolymers containing these structural units include olefin monomers such as ethylene, propylene, butene, hexene and octene, diene monomers such as butadiene and isoprene, cyclic olefin monomers, cyclic diene monomers, and polar vinyl monomers such as methyl methacrylate, maleic anhydride and acrylonitrile, as well as monomers of the styrenic polymers as described above.

Of these, particularly preferred examples of the styrenic polymers include polystyrene, the poly(alkylstyrenes), hydrogenated polystyrene and the copolymers containing structural units thereof.

Although there is no particular limitation on the molecular weight of the styrenic polymers, the weight average molecular weight is preferably 10,000 to 3,000,000, and more preferably 50,000 to 1,500,000. There is also no particular limitation on the molecular weight distribution, and the styrenic polymers having various distributions can be used. However, the ratio of weight average molecular weight (Mw) to number average molecular weight (Mn) is preferably 1.5 to 8. These syndiotactic styrenic polymers are markedly excellent in heat resistance as compared with the conventional atactic styrenic polymers.

Such syndiotactic styrenic polymers can be produced, for example, by polymerizing styrenic monomers (monomers corresponding to the above-mentioned styrenic polymers) in an inert hydrocarbon solvent or in the absence of a solvent using a titanium compound and a condensation product of water and trialkylaluminum as catalysts (JP-A-62-187708). Alternatively, they can be produced by conducting polymerization using as catalysts titanium compounds and compounds composed of cations and anions in which a plurality of groups are bonded to elements (JP-A-4-249504).

Raw materials for forming a film which can be used in the present invention comprises the syndiotactic styrenic polymer preferably in an amount of 70% by weight or more, more preferably 90% by weight or more.

The raw materials for forming a film may contain other resin components as long as the object of the present invention is attained. Examples of such resin components include atactic or syndiotactic styrenic polymers, polyphenylene ethers, polyolefins such as polyethylene, polypropylene, polybutene and polypentene, polyesters such as polyethylene terephthalate, polybutylene terephthalate and polyethylene naphthalate, polyamides such as nylon-6 and nylon-6,6, polythioethers such as polyphenylene sulfide, polycarbonates, polyarylates, polysulfones, polyether ether ketone, polyethersulfones, polyimides, vinyl halide polymers such as Tefron, acrylic polymers such as polymethyl methacrylate, polyvinyl alcohol, and crosslinked resins containing the above-mentioned resins.

The raw materials can further contain fine inorganic particles, antioxidants, antistatic agents, dyes, etc. as long as the object of the present invention is attained.

The fine inorganic particles which can be used herein include oxides of elements of the groups IA, IIA, IVA, VIA, VIIA, VIII, IB, IIB, IIIB and IVB, hydroxides, sulfides, nitrides, halides, carbonates, acetates, phosphates, phosphites, organic carboxylates, silicates, titanates, borates, hydrates thereof, complex compounds mainly containing these compounds and natural mineral particles. Examples thereof include compounds of the group IA elements such as lithium fluoride and sodium borate hydrate (borax); compounds of the group IIA elements such as magnesium carbonate, magnesium phosphate, magnesium oxide (magnesia), magnesium chloride, magnesium acetate, magnesium fluoride, magnesium titanate, magnesium silicate, magnesium silicate hydrate, (talc), calcium carbonate, calcium phosphate, calcium phosphite, calcium sulfate (gypsum), calcium acetate, calcium terephthalate, calcium hydroxide, calcium silicate, calcium fluoride, calcium titanate, strontium titanate, barium carbonate, barium phosphate, barium sulfate and barium phosphite; compounds of the group IVA elements such as titanium dioxide (titania), titanium monoxide, titanium nitride, zirconium dioxide (zirconia) and zirconium monoxide; compounds of the group VIA elements such as molybdenum dioxide, molybdenum trioxide and molybdenum sulfide; compounds of the group VIIA elements such as manganese chloride and manganese acetate; compounds of the group VIII elements such as cobalt chloride and cobalt acetate; compounds of the group IB such as cuprous iodide; compounds of the group IIB elements such as zinc oxide and zinc acetate; compounds of the group IIIB elements such as aluminium oxide (alumina), aluminum fluoride and aluminosilicates (e.g., aluminum silicate, kaolin and kaolinite); compounds of the group IVB elements such as silicon oxide (e.g., silica and silica gel), carbon, graphite and glass; and natural mineral particles such as carnallite, kainite, mica (e.g., mica, phlogopite) and pyrolusite.

The SPS film which can be used in the present invention is formed of the raw materials as described above, and have a thickness of 20 to 500 μm and a haze of 3% or less. In order to obtain the SPS films having such a thickness and such a haze, styrenic polymers having relatively low crystallization rate are suitably used.

Of the above-mentioned styrenic polymers, the polymers having low crystallization rate are random copolymers containing 30 mol % or less of copolymerization components other than styrene, for example, styrene-alkylstyrene copolymers. Herein, the content of alkylstyrene units is 1 to 30 mol %, preferably 1 to 20 mol %, and more preferably 1 to 15 mol %.

Further, in order to obtain the film having the characteristics as described above, the amount of residual styrene monomers contained in the styrenic polymer or compositions thereof (raw materials for forming a film) is preferably 7,000 ppm or less. Such a styrenic polymer or composition is preferably obtained by the following processes.

(1) The styrenic polymer polymerized or treated is dried under vacuum. In drying under vacuum, it is effective to dry the polymer at a temperature not less than the glass transition temperatures of the polymer.

(2) The polymer is degassed by use of an extruder, and concurrently extruded to molding materials (pellets). The extruder is preferably equipped with a vent, and may be any of single-screw and double-screw extruders.

If the amount of the residual volatile monomers exceeds 7,000 ppm, there is a possibility that foams are developed at the time of extrusion and forming or surfaces are roughened on drawing, resulting in a haze exceeding 3%.

The film can be produced using the above-described styrenic polymer or the composition containing the polymer.

There is no particular limitation on the methods of manufacturing the film as long as the above-mentioned object can be attained. Specifically, the film can be produced by melting the polymer by heating, extruding the melted polymer, and solidifying the extruded polymer by cooling. The extruders used herein may be any of single-screw and double-screw extruders, and may be equipped with a vent. The extruder is preferably provided with an appropriate mesh filter to pulverize and remove secondary coagulated particles or to remove dust and contaminants.

Further, there is no particular limitation on the extrusion conditions, and they may be appropriately selected according to various situations. It is however preferred that the temperature is selected within the range of the melting point of the styrenic polymer to a temperature 50° C. higher than the decomposition temperature thereof, and that a T-die is used.

After the above-mentioned extrusion forming, the resulting preformed products (as-extruded films) are solidified by cooling. In this case, various means such as gases, liquids and metal rolls can be used as cooling media. When the metal rolls are used, use of air knives, air chambers, touch rolls, electrostatic application, etc. is effective for prevention of unevenness in thickness and waving.

The temperature of solidification by cooling is usually within the range of 0° C. to a temperature 30° C. higher than the glass transition temperature of the as-extruded film, and preferably within the range of a temperature 50° C. lower than the glass transition temperature to the glass transition temperature. The cooling rate is appropriately selected within the range of 3° to 200° C./second. The as-extruded films thus obtained have a thickness of 100 to 5,000 μm.

Then, the as-extruded films solidified by cooling are uniaxially or biaxially oriented. In the case of biaxial orientation, the films may be oriented longitudinally and laterally at the same time, or successively in any order. Further, the films may be oriented in one stage or multiple stages.

Orienting methods include various methods such as a method of using a tenter, a method of orienting the film between rolls, a method of using bubbling by use of gas pressure and a method of orienting the films by rolling, and they may be appropriately selected to use or may be used in combination. The temperature of orientation may be generally selected between the glass transition temperature of the as-extruded film and the melting point thereof.

When the film is oriented successively or in multiple stages, it is preferred that the film is oriented at a temperature ranging from the glass transition temperature to the cold crystallization temperature in the first stage, and at a temperature ranging from the glass transition temperature to the melting point in a later stage. Further, the rate of orientation is usually 1×10 to $1\times10^7$%/minute, and preferably $1\times10^3$ to $1\times10^7$%/minute.

The area ratio of orientation is 8 times or more, and preferably 10 times or more. A ratio of less than 8 times results in difficulty of obtaining the film sufficient in transparency, smoothness, heat-absorbing dimensional stability and thermal dimensional stability.

The oriented films obtained under the conditions as described above are preferably heat set to improve dimensional stability at high temperature, heat resistance and strength balance in film planes. The heat setting can be conducted by conventional methods, and the oriented film may be heat set by maintaining the film at a temperature ranging from the glass transition temperature of the film to the melting point thereof, preferably from the upper-limit temperature of the use circumstances to the melting point, in tensioned state, tensional freed state or restrictively contracted state, for 0.5 to 1880 seconds. It is also possible to conduct this heat setting twice or more changing the conditions within the above-mentioned range. Further, this heat setting may be conducted in an atmosphere of an inert gas such as an argon gas or a nitrogen gas. In order to obtain the film low in heat shrinkage, at least one of the heat setting stages is preferably conducted in the restrictively contracted state, and the ratio of restrictive contraction is 20% or less longitudinally and/or laterally, and preferably 15% or less.

Further, the conditions of orientation and heat setting are preferably adjusted so as to give an absolute value of birefringence of film $|\Delta n|$ of $40\times10^{-3}$ or less, thereby obtaining the films excellent in transparency.

PRODUCTION EXAMPLE 1

(1) Preparation of Contact Product of Trimethylaluminum with Water

In a glass vessel having a content volume of 500 ml replaced with argon, 17.8 g (71 mmol) of copper sulfate pentahydrate ($CuSO_4.5H_2O$), 200 ml of toluene and 24 ml (250 mmol) of trimethylaluminum were placed, and allowed to react at 40° C. for 8 hours. Then, solid portions were removed from the resulting solution, and toluene was further removed by distillation under reduced pressure at room temperature to obtain 6.7 g of a contact product. The molecular weight of the contact product measured by the cryoscopic method was 610.

(2) Production of Styrenic Polymer

In a reaction vessel having a content volume of 2 liters, 950 ml of purified styrene, 50 ml of p-methylstyrene, 5 mmol of the contact product obtained in (1) described above as aluminum atoms, 5 mmol of triisobutylaluminum and 0.025mmol of pentamethylcyclopentadienyltitanium trimethoxide were placed, and polymerized at 90° C. for 5 hours. After termination of reaction, the product was treated with a solution of sodium hydroxide in methanol to decompose the catalyst components, and then, repeatedly washed with methanol, followed by drying to obtain 308 g of a polymer.

It could be confirmed by $^{13}$C-NMR that the resulting copolymer had the cosyndiotactic structure and contained 9.5 mol % of p-methylstyrene units. Further, the weight average molecular weight was 438,000 and the weight average molecular weight/number average molecular weight was 2.51.

PRODUCTION EXAMPLE 2

Production of Styrenic Polymer (JP-A-1-316246, Reference Example 2)

In a reaction vessel, 6 liters of toluene as a reaction solvent, 5 mmol of tetraethoxytitanium and 500 mmol of methylaminoxane as aluminum atoms were placed, and 48.75 mol of styrene and 1.25 mol of p-methylstyrene were added thereto at 50° C., followed by polymerization for 2 hours.

After termination of reaction, the product was washed with a mixed solution of hydrochloric acid and methanol to decompose and remove the catalyst components, followed by drying to obtain 640 g of a copolymer. This copolymer had a weight average molecular weight of 440,000, a number average molecular weight of 240,000 and a melting point of 255° C. The ratio of p-methylstyrene contained in the copolymer was 5 mol %. From analysis of this copolymer by $^{13}$C-NMR, absorption was observed at 145.11 ppm, 145.22 ppm and 142.09 ppm, and the syndiotacticity of styrene units in the racemic pentad calculated from its peak area was 72%.

In order to strongly adhere a hydrophilic colloidal layer which contains gelatin as a main component (for example, a silver halide emulsion layer, an antihalation layer, an intermediate layer, a backing layer, etc.) to the SPS film support to be used in the present invention, the following two methods previously known can be used:

(1) A method of subjecting the supports to surface activating treatment such as chemical treatment, physical treatment, corona discharge treatment, flame treatment, ultraviolet treatment, high frequency treatment, glow discharge treatment, active plasma treatment, laser treatment, mixed acid treatment or ozone oxidation treatment, followed by direct coating with a photographic emulsion to obtain adhesion; and (2) A method of forming a subbing layer on the support after or without the surface treatment, and forming a photographic emulsion layer thereon.

For example, these two methods are described in U.S. Pat. Nos. 2,698,241, 2,764,520, 2,864,755, 3,462,335, 3,475,193, 3,143,421, 3,501,301, 3,460,944 and 3,674,531, British Patents 788,365, 804,005 and 891,469, JP-B-48-43122 and JP-B-51-446.

All of these surface treatment procedures are considered to introduce polar groups more or less onto the surface of the support which have been essentially hydrophobic and increase the crosslinking density of the surface, thereby increasing the affinity with the polar groups of the components contained in a solution for an subbing solution and increasing the fastness of the adhesion surface.

Further, for the subbing layer, various structures are proposed. There are the so-called multilayer structure method in which a layer well adhesive to a support (this layer is hereinafter referred to as a first subbing layer for brevity) is formed on the support as a first layer and a hydrophilic resin layer well adhesive to a photographic layer (this hydrophilic resin layer is hereinafter referred to as a second subbing layer for brevity) is formed thereon as a second layer, and the monolayer structure method in which only one resin layer containing both hydrophobic and hydrophilic groups is formed on a support.

Of the surface treatment procedures described in (1), corona discharge treatment is a best-known procedure, and can be achieved by any known processes, for example, processes disclosed in JP-B-48-5043, JP-B-47-51905, JP-A-47-28067, JP-A-49-83767, JP-A-51-41770 and JP-A-51-131576. The discharge frequency is suitably 50 Hz to 5,000 kHz, and more preferably 5 kHz to hundreds of kilohertz. Too low discharge frequency can not provide stable discharge and produces pin holes in materials to be treated. Too high discharge frequency requires special equipment for impedance matching, unfavorably resulting in high cost of the equipment. The treating intensity for materials to be treated is suitably 0.001 to 5 kV.A.minute/m$^2$, and preferably 0.01 to 1 kV.A.minute/m$^2$ to improve the wettability of plastic films such as normal polyesters and polyolefins. The gap clearance between an electrode and an inductive roll is suitably 0.5 to 2.5 mm, and preferably 1.0 to 2.0 mm.

In many cases, glow discharge treatment, most effective surface treatment, can be conducted by any known process, for example, processes described in JP-B-35-7578, JP-B-36-10336, JP-B-45-22004, JP-B-45-22005, JP-B-45-24040, JP-B-46-43480, U.S. Pat. Nos. 3,057,792, 3,057,795, 3,179,482, 3,288,638, 3,309,299, 3,424,735, 3,462,335, 3,475,307 and 3,761,299, British Patent 997,093 and JP-A-53-129262.

For the conditions of glow discharge treatment, the pressure is generally 0.005 to 20 Torr, and preferably 0.02 to 2 Torr. Too low pressure results in a reduction in surface treatment effect, whereas too high pressure causes flow of excess current, which leads to easy occurrence of sparks to introduce danger and raises fear of destruction of the materials to be treated. The discharge is produced by applying a high voltage between at least one pair of metal plates or metal rods spaced in a vacuum tank. Although this voltage can take various values according to the composition and the pressure of an atmosphere gas, stable stationary glow discharge can usually be generated between 500 to 5,000 V within the above-mentioned pressure range. The range of voltage particularly preferred for improving the adhesion is 2,000 to 4,000 V.

The discharge frequency is suitably from direct current to thousands of megahertz, and preferably 50 Hz to 20 MHz, as is seen in the prior art. The discharge treating intensity is suitably 0.01 to 5 kV.A.minute/m$^2$, and preferably 0.15 to 1 kV.A.minute/m$^2$, because the desired adhesive quality can be obtained.

Then, the subbing procedures of (2) are described. All these procedures are well studied. For the first subbing layer in the multilayer structure method, a number of polymers have been studied such as polyethyleneimine, epoxy resins, grafted gelatin and nitrocellulose, besides copolymers prepared by using monomers selected from vinyl chloride, vinylidene chloride, butadiene, methacrylic acid , acrylic acid, itaconic acid, maleic anhydride, etc. as starting materials. For the second subbing layer, the characteristics of gelatin have been studied.

In the monolayer structure method, many supports are swelled to interfacially mix with hydrophilic subbing polymers, thereby achieving good adhesive quality in many cases.

Examples of the hydrophilic subbing polymer used in the present invention include water-soluble polymers, cellulose esters, latex polymers and water-soluble polyesters. Examples of the water-soluble polymer include gelatin, gelatin derivatives, casein, agar, sodium alginate, starch, polyvinyl alcohol, acrylic acid copolymers, and maleic anhydride copolymers, and examples of the cellulose ester include carboxymethyl cellulose, and hydroxyethyl cellulose. Examples of the latex polymer include a vinyl chloride-containing copolymer, a vinylidene chloride-containing copolymer, an acrylate-containing copolymer, a vinyl acetate-containing copolymer, and a butadiene-containing copolymer. Of these, gelatin is most preferred.

Compounds swelling the support to be used in the present invention include resorcin, chlororesorcin, methylresorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid and chloral hydrate.

The subbing layer to be used in the present invention can contain fine inorganic particles such as $SiO_2$, $TiO_2$ and matte agents, or fine polymethyl methacrylate copolymer particles (having a particle size of 1 to 10 μm), as a matte agent.

In addition, the subbing solution (a solution for a subbing layer) can contain various additives such as a surfactant, an antistatic agent, an antihalation agent, a coloring dye, a pigment, a coating aid and an antifoggant, if desired. In the present invention, when the subbing solution for the first subbing layer is used, it is not necessary at all to add an etching agent such as resorcin, chloral hydrate and chlorophenol to the subbing solution. However, the etching agent may be added to the subbing solution, if desired.

The subbing solution can be applied by any coating method generally well known, for example, dip coating, air knife coating, curtain coating, roller coating, wire bar coating, gravure coating and extrusion coating using a hopper described in U.S. Pat. No. 2,681,294. Two or more layers can be concurrently formed by methods described in U.S. Pat. Nos. 2,761,791, 3,508,947, 2,941,898 and 3,526,528, Yuji Harasaki, *Coating Kohgaku* (*Coating Engineering*), page 253, Asakura Shoten (1973), etc., if desired.

The hydrazine derivative used in the present invention is preferably a compound represented by the following formula (I):

$$R_1—NHNH—G_1—R_2 \quad (I)$$

wherein $R_1$ represents an aliphatic group or an aromatic group; $R_2$ represents a hydrogen atom or a block group; and $G_1$ represents a —CO— group, a —$SO_2$— group, a —SO— group, a —CO—CO— group, a thiocarbonyl group, an iminomethylene group or a —P(O)($R_3$)— group, wherein $R_3$ has the same meaning as defined for $R_2$ and may be different from $R_2$.

In formula (I), the aliphatic group represented by $R_1$ is preferably a group having 1 to 30 carbon atoms, and particularly a straight chain, branched or cyclic alkyl group having 1 to 20 carbon atoms. Here, the branched alkyl group may be cyclized so as to form a saturated heterocyclic ring containing one or more heteroatoms. This alkyl group may further have a substituent.

In formula (I), the aromatic group represented by $R_1$ is a monocyclic or bicyclic aryl group or an unsaturated heterocyclic group. Here, the unsaturated heterocyclic group may be cyclocondensed with a monocyclic or bicyclic aryl group to form a heteroaryl group. Examples thereof include groups containing benzene, naphthalene, pyridine, pyrimidine, imidazole, pyrazole, quinoline, isoquinoline, benzimidazole, thiazole and benzothiazole rings, and groups containing a benzene ring are preferred.

As $R_1$, an aryl group is particularly preferred.

The aliphatic group or the aromatic group represented by $R_1$ may be substituted with substituent(s). Typical examples of the substituent include alkyl, alkenyl, alkynyl, aryl, groups containing a heterocyclic ring, pyridinium, hydroxyl, alkoxyl, aryloxy, acyloxy, alkylsulfonyloxy or arylsulfonyloxy, amino, carbonamido, sulfonamido, ureido, thioureido, semicabazido, thiosemicabazido, urethane, groups having hydrazide structure, groups having quaternary ammonium structure, alkylthio or arylthio, alkylsulfonyl or arylsulfonyl, alkylsulfinyl or arylsulfinyl, carboxyl, sulfo, acyl, alkoxycarbonyl or aryloxycarbonyl, carbamoyl, sulfamoyl, halogen atoms, cyano, phosphoric acid amido, diacylamino, imido, groups having acylurea structure, groups containing selenium or tellurium atom and groups having tertiary or quaternary sulfonium structure. Preferred examples of the substituent include a straight chain, branched or cyclic alkyl group (preferably having 1 to 20 carbon atoms), an aralkyl group (preferably, a monocyclic or bicyclic group in which alkyl moieties have 1 to 3 carbon atoms), an alkoxyl group (preferably having 1 to 20 carbon atoms), a substituted amino group (preferably, an amino group substituted by an alkyl group having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms) and a phosphoric acid amido group (preferably having 1 to 30 carbon atoms).

Examples of the block group represented by $R_2$ include an alkyl group, an aryl group, an unsaturated heterocyclic group, an alkoxyl group, an aryloxy group, an amino group and a hydrazino group.

In formula (I), the alkyl group represented by $R_2$ is preferably an alkyl group having 1 to 4 carbon atoms, and the aryl group is preferably a monocyclic or bicyclic aryl group, for example, a group containing a benzene ring.

The unsaturated heterocyclic group is a 5- or 6-membered ring compound containing at least one of nitrogen, oxygen and sulfur atoms. Examples thereof include imidazolyl, pyrazolyl, triazolyl, tetrazolyl, pyridyl, pyridinium, quinolinium and quinolinyl. Pyridyl and pyridinium are particularly preferred.

The alkoxyl group is preferably an alkoxyl group having 1 to 8 carbon atoms, and the aryloxy group is preferably a monocyclic group. The amino group is preferably an unsubstituted amino group or an alkylamino or arylamino group having 1 to 10 carbon atoms.

$R_2$ may be substituted by substituent(s), and preferred examples of the substituent include the same as shown for $R_1$.

Of the groups represented by $R_2$, an alkyl group (e.g., methyl, trifluoromethyl, 3-hydroxypropyl, 3-methanesulfonamidopropyl or phenylsulfonylmethyl), an aralkyl group (e.g., o-hydroxybenzyl) or an aryl group (e.g., phenyl, 3,5-dichlorophenyl, o-methanesulfonamidophenyl, 4-methanesulfonylphenyl or 2-hydroxymethylphenyl) is preferred, when $G_1$ is a —CO— group. In particular, a hydrogen atom and a trifluoromethyl group are preferred.

When $G_1$ is a —$SO_2$— group, $R_2$ is preferably an alkyl group (e.g., methyl), an aralkyl group (e.g., o-hydroxybenzyl), an aryl group (e.g., phenyl) or a substituted amino group (e.g., dimethylamino).

When $G_1$ is a —COCO— group, $R_2$ is preferably an alkoxyl group, an aryloxy group or an amino group.

$G_1$ of formula (I) is preferably a —CO— group or a —COCO— group, and a —CO— group is most preferred.

Further, $R_2$ may be a group which cleaves the $G_1$—$R_2$ moiety from the residual molecule to induce cyclization reaction for forming a cyclic structure containing atoms of the —$G_1$—$R_2$ moiety, and examples thereof include groups described in JP-A-63-29751, etc.

The substituents for $R_1$ and $R_2$ of formula (I) may be further substituted, and preferred examples thereof include the groups shown as the substituents for $R_1$. The substituents may be further substituted in multiple, such as substitution of the substituents, substitution of the substituents for the substituents, substitution of the substituents for the substituents for the substituents, etc., and preferred examples thereof also include the groups shown as the substituents for $R_1$.

$R_1$ or $R_2$ of formula (I) may be a group in which a ballasting group or a polymer commonly used in an inert photographic additive such as a coupler is incorporated. The ballasting groups are groups having 8 or more carbon atoms which are relatively inactive to photographic characteristics. For example, they can be selected from alkyl, aralkyl, alkoxyl, phenyl, alkylphenyl, phenoxy, alkylphenoxy, etc. The polymer include those described in JP-A-1-100530.

$R_1$ or $R_2$ of formula (I) may be a group in which a group for enhancing adsorption to surfaces of silver halide grains is incorporated. Such adsorption groups include groups such as alkylthio, arylthio, thiourea, heterocyclic thioamido, mercaptoheterocyclic groups and triazole described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

In the present invention, the particularly preferred hydrazine derivative is a hydrazine derivative in which $R_1$ is a phenyl group having a ballsting group, a group for enhancing adsorption to surfaces of silver halide grains, a group having quaternary ammonium structure or an alkylthio group, through a sulfonamido group, an acylamino group or an ureido group, $G_l$ is a —CO— group or a —COCO— group, and $R_2$ is a substituted alkyl group or a substituted aryl group (an electron attractive group or a hydroxymethyl group at the 2-position is preferred as the substituent). All combinations of the above-mentioned groups for $R_1$ and $R_2$ are available and preferred.

Examples of the compounds represented by formula (I) are shown below, but the present invention is not limited thereto.

Compound 1

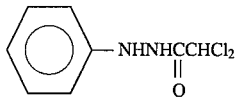

Compound 2

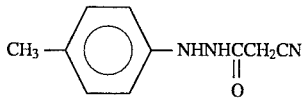

Compound 3

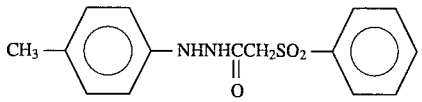

Compound 4

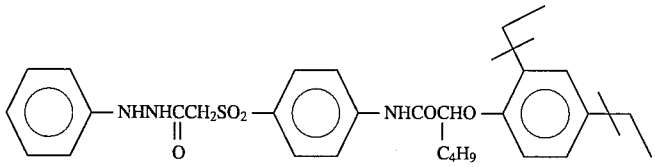

Compound 5

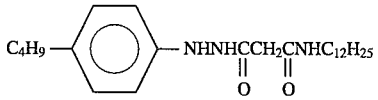

Compound 6

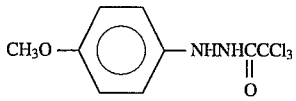

Compound 7

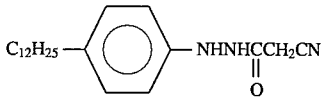

Compound 8

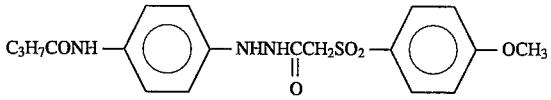

Compound 9

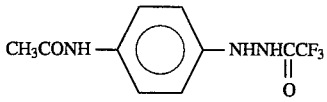

Compound 10

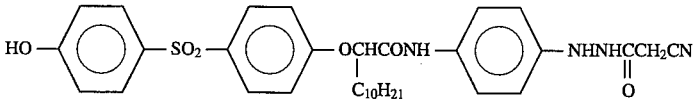

Compound 11

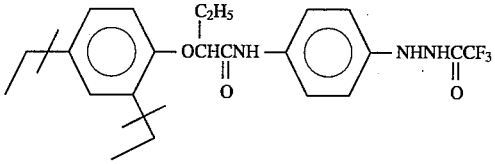

-continued
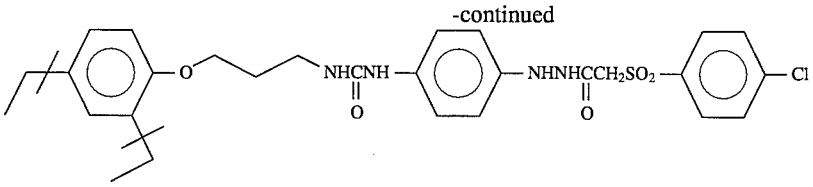
Compound 12
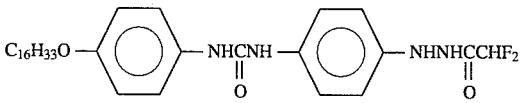
Compound 13
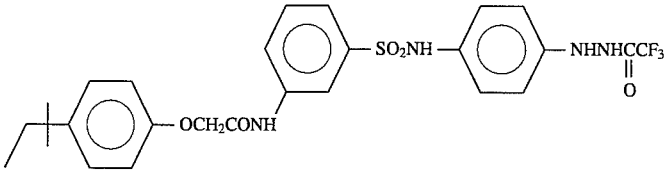
Compound 14
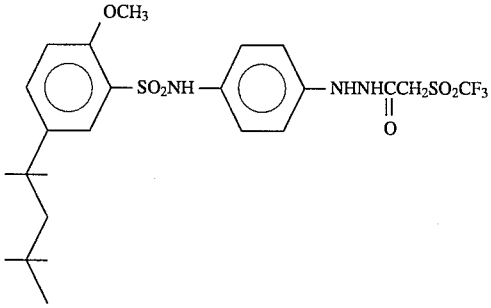
Compound 15
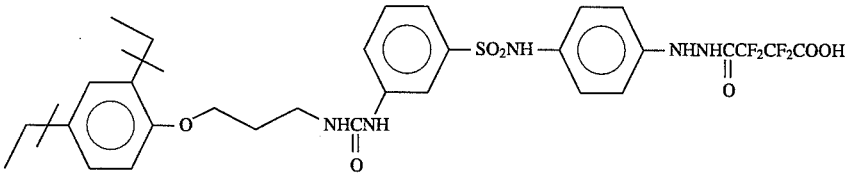
Compound 16
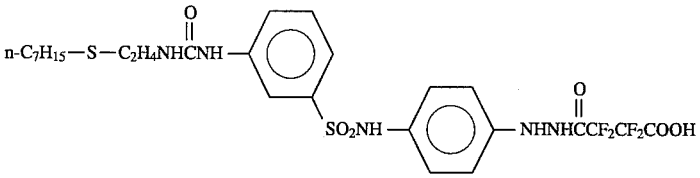
Compound 17
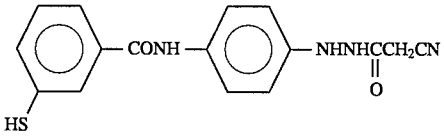
Compound 18
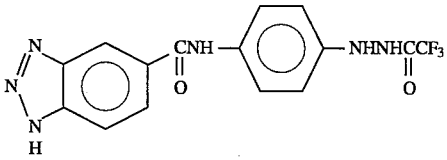
Compound 19
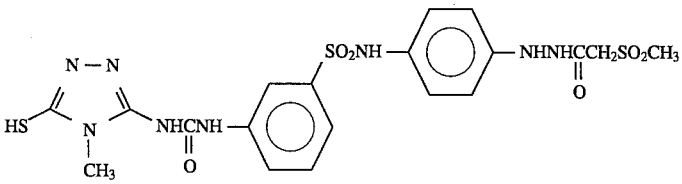
Compound 20

-continued
Compound 21
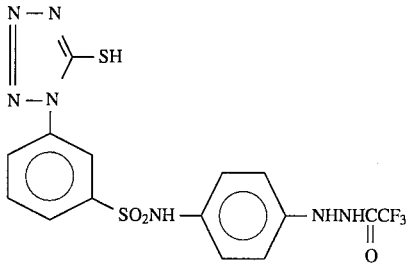
Compound 22
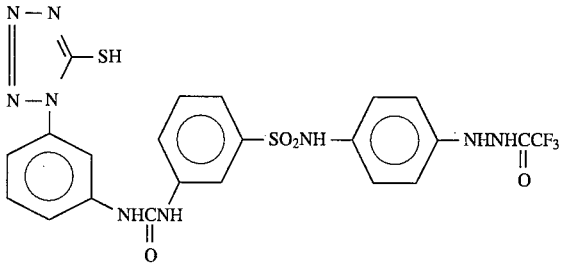
Compound 23
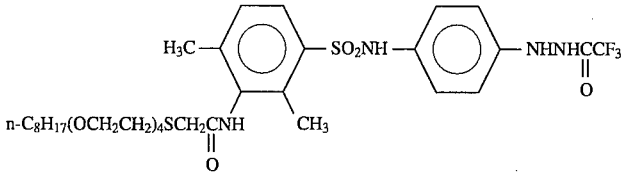
Compound 24
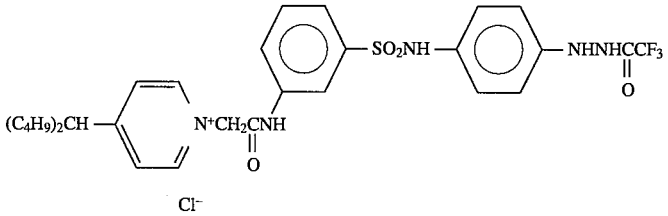
Compound 25
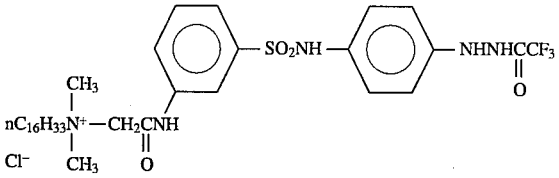
Compound 26
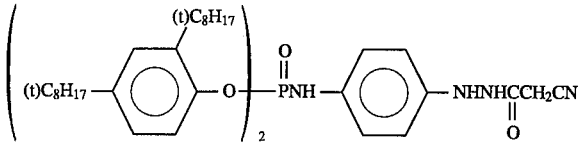
Compound 27
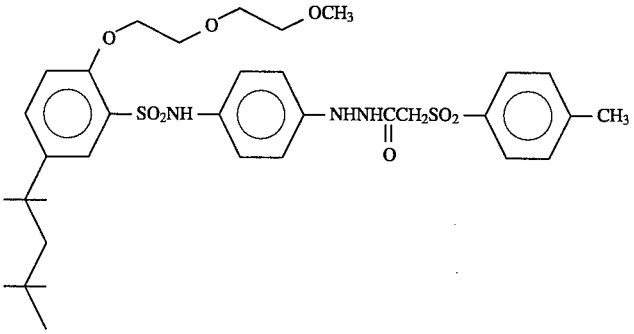

-continued
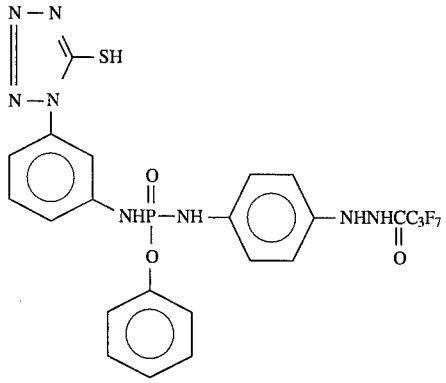
Compound 28
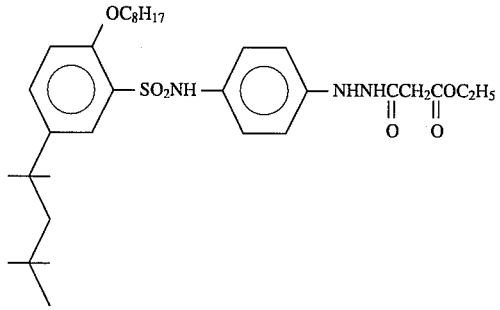
Compound 29
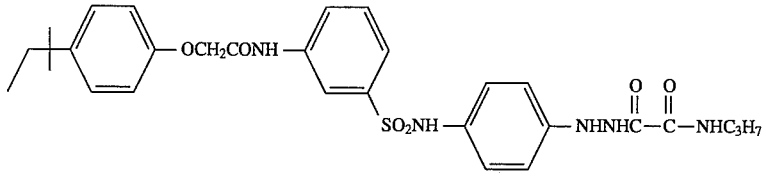
Compound 30
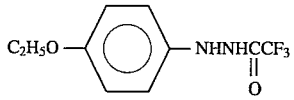
Compound 31
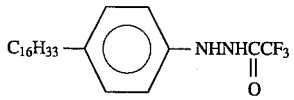
Compound 32
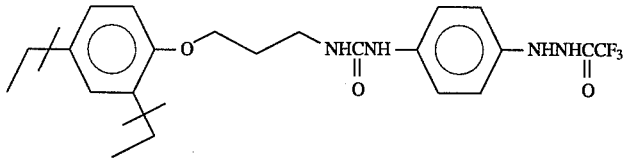
Compound 33
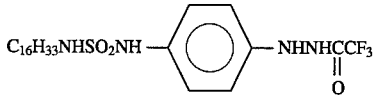
Compound 34
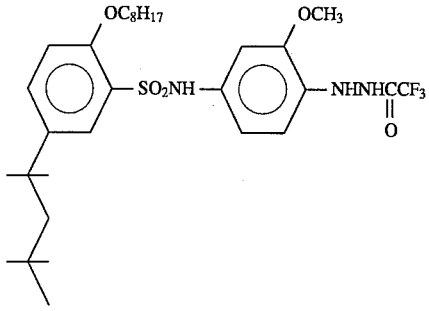
Compound 35

-continued
Compound 36
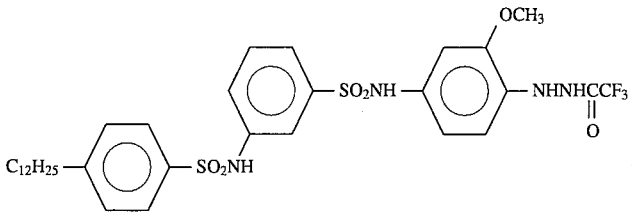
Compound 37
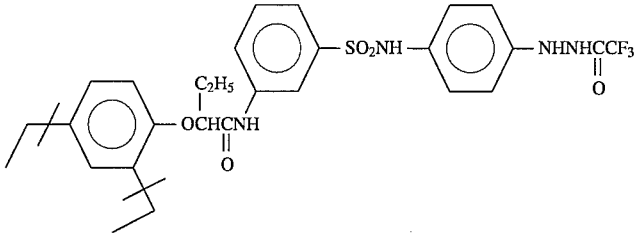
Compound 38
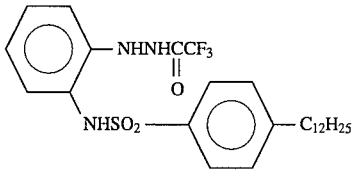
Compound 39
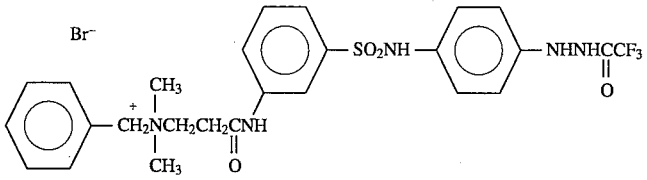
Compound 40
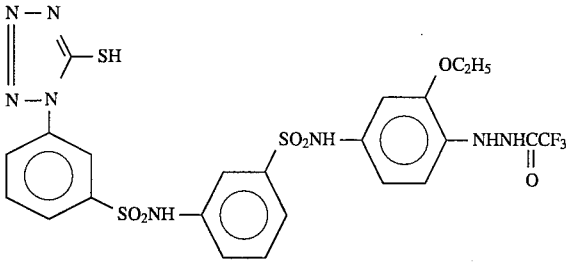
Compound 41
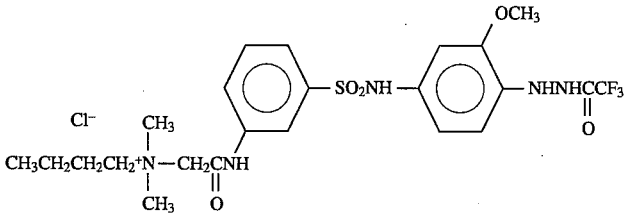
Compound 42
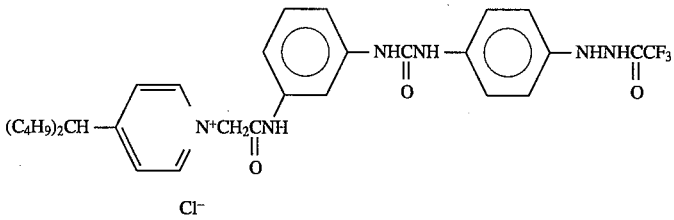

-continued

Compound 43

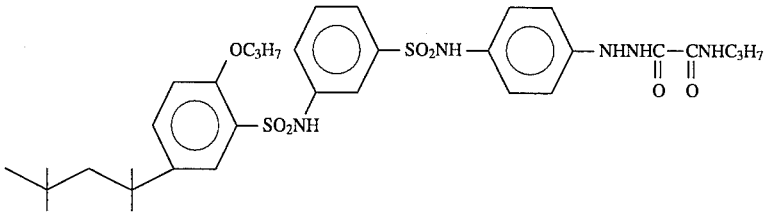

Compound 44

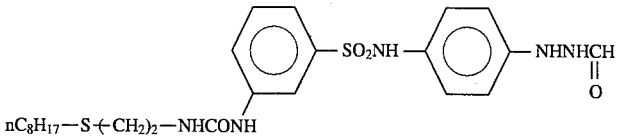

Compound 45

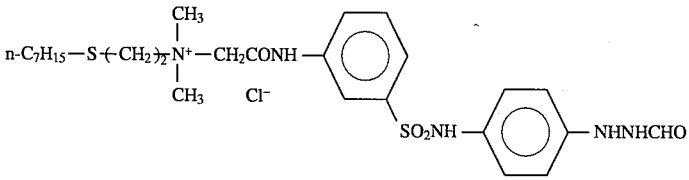

Compound 46

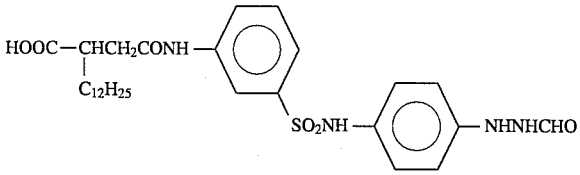

In addition to the above-mentioned hydrazine derivatives, hydrazine derivatives can be used in the present invention which are described in *Research Disclosure*, Item 23516, page 346 (November, 1983) and literatures cited therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent 2,011,391B, European Patents 217,310, 301, 799 and 356,898, JP-A-60-179734, JP-A-61-170733, JP-A-61-270744, JP-A-62-178246, JP-A-62-270948, JP-A-63-29751, JP-A-63-32538, JP-A-63-104047,JP-A-63-121838, JP-A-63-129337,JP-A-63-223744, JP-A-63-234244,JP-A-63-234245,JP-A-63-234246,JP-A-63-294552, JP-A-63-306438, JP-A-64-10233, JP-A-1-90439, JP-A-l-100530, JP-A-1-105941, JP-A-l-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765 and Japanese Patent Application No. 5-94925.

In the present invention, the hydrazine derivative is added preferably in an amount of $1\times10^{-6}$ to $5\times10^{-2}$ mol per mol of silver halide, and particularly in an amount of $1\times10^{-5}$ to $2\times10^{-2}$ mol per mol of silver halide. As a layer which the hydrazine derivative is incorporated into, a silver halide emulsion layer or a hydrophilic colloidal layer adjacent to the silver halide emulsion layer is preferred, and a silver halide emulsion layer is most preferred.

In the present invention, the hydrazine derivative can be used by dissolving it in an appropriate water-miscible organic solvent such as alcohols (e.g., methanol, ethanol, propanol and fluorinated alcohol), ketones (e.g., acetone and methyl ethyl ketone), dimethylformamide, dimethyl sulfoxide and methyl cellosolve.

Further, the hydrazine derivative can also be dissolved using oils such as dibutyl phthalate, tricresyl phosphate, glyceryl triacetate and diethyl phthalate, or supplementary solvents such as ethyl acetate and cyclohexanone, and emulsified dispersions are mechanically prepared by any well-known emulsifying dispersion method. Alternatively, the hydrazine derivative can also be used by dispersing the powder thereof in water with a ball mill, a colloid mill or ultrasonic waves.

The silver halide emulsion layer or at least one of other hydrophilic colloidal layers preferably contain a nucleating accelerator selected from amine derivatives, onium salts, disulfide derivatives and hydroxymethyl derivatives.

The nucleating accelerator may be used alone or in combination of two or more thereof.

Examples of the amine derivative include, for example, compounds described in JP-A-60-140340, JP-A-62-50829, JP-A-62-222241, JP-A-62-250439, JP-A-62-280733, JP-A-63-124045, JP-A-63-133145 and JP-A-63-286840. More preferably, the amine derivative is a compound having a group adsorbed by silver halides described in JP-A-63-124045, JP-A-63-133145, JP-A-63-286840, etc. or a compound having 20 or more carbon atoms described in JP-A-62-222241, etc.

As the onium salts, ammonium salts or phosphonium salts are preferred. Preferred examples of the ammonium salt include compounds described in JP-A-62-250439, JP-A-62-280733, etc. Further, preferred examples of the phosphonium salts include compounds described in JP-A-61-167939, JP-A-62-280733, etc.

Examples of the disulfide derivative include compounds described in JP-A-61-198147.

The hydroxymethyl derivative include, for example, compounds described in U.S. Pat. Nos. 4,693,956 and 4,777,118, EP 231,850, JP-A-62-50829, etc., and more preferably diarylmethanol derivatives.

Examples of the nucleating accelerator are described in JP-A-6-266038. The nucleating accelerator is preferably used in an amount of $1.0\times10^{-2}$ to $1.0\times10^{2}$ mol per mol of the hydrazine compound, and more preferably in an amount of $1.0\times10^{-1}$ to $1.0\times10$ mol per mol of the hydrazine compound, although the optimum amount varies depending on the kind thereof. The nucleating accelerator can be incorporated into a layer containing the hydrazine derivative or any other hydrophilic colloidal layer.

These compounds are dissolved in an appropriate solvent ($H_2O$, alcohols such as methanol and ethanol, acetone, dimethylformamide, methyl cellosolve, etc.), followed by addition to coating solutions.

In the present invention, the total amount of gelatin on a photosensitive emulsion-coated surface is preferably 2.5 g/m$^2$ or less, and more preferably 1 g/m$^2$ to 2.2 g/m$^2$. A smaller amount of gelatin is preferred from the viewpoint of dimensional stability, but increases black spot fog. It is therefore practically meaningless to decrease the gelatin amount as long as the amount is within the range allowable for dimensional stability.

The gelatin amount on a back surface is decided so as to flatten a film before and after development and balance with the gelatin amount on the photosensitive emulsion surface. It is preferably 80 to 130% by weight of the gelatin amount on the photosensitive emulsion surface although it varies depending on the content of a polymer latex.

In the photographic material to be used in the present invention, the silver halide emulsin layers and/or other hydrophilic colloidal layers (e.g., an underlayer, a protecitve layer, a back layer) may contain a polymer latex. As the polymer latex, various latexes which have previously been known can be used. Polymer latexes having repeating units derived from ethylenic unsaturated monomers having active methylene groups are particularly preferred. Such a polymer latex is represented by the following formula (V):

$$-(C)_x-(A)_y-(B)_z- \qquad (V)$$

wherein C represents a repeating unit derived from an ethylenic unsaturated monomer containing an active methylene group; A represents a repeating unit other than C, which is derived from an ethylenic unsaturated monomer whose homopolymer indicates a glass transition temperature of 35° C. or less; B represents a repeating unit other than C and A, which is derived from an ethylenic unsaturated monomer; and x, y and z each represents the weight percentage ratio of each component, x is 0.5 to 40, y is 60 to 99.5, and z is 0 to 50 wherein x+y+z=100.

The active methylene group-containing ethylenic unsaturated monomer from which the repeating unit represented by C is derived is represented by the following formula:

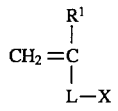

wherein $R^1$ represents a hydrogen atom, an alkyl group having 1 to 4 carbon atoms (e.g., methyl, ethyl, n-propyl or n-butyl) or a halogen atom (e.g., chlorine or bromine), and preferably a hydrogen atom, a methyl group or a chlorine atom; and L represents a single bond or a divalent linking group, and is represented by the following formula:

$$-(L^1)_m-(L^2)_n-$$

wherein $L^1$ represents —CON($R_2$)— ($R^2$ represents a hydrogen atom, an alkyl group having 1 to 4 carbon atoms or a substituted alkyl group having 1 to 6 carbon atoms), —COO—, —NHCO—, —OCO—,

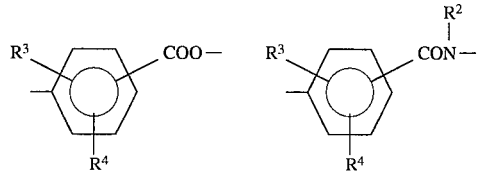

($R^3$ and $R^4$ each independently represents a hydrogen atom, a hydroxyl group, a halogen atom, a substituted or unsubstituted alkyl group, an alkoxyl group, an acyloxy group or an aryloxy group): $L^2$ represents a linking group connecting $L^1$ to X : m represents 0 or 1; and n represents 0 or 1. The linking group represented by $L^2$ is represented by the following formula:

$$-[X^1-(J^1-X^2)_p-(J^2-X^3)_q-(J^3)_r]_2-$$

$J^1$,$J^2$ and $J_3$, which may be the same or different, each represents —CO—, —$SO_2$—, —CON($R^5$)— ($R^5$ is a hydrogen atom, an alkyl group having 1 to 6 carbon atoms or a substituted alkyl group having 1 to 6 carbon atoms), —$SO_2$N($R^5$)— ($R^5$ has the same meaning as described above), —N($R^5$)—$R^6$— ($R^5$ has the same meaning as described above, and $R^6$ is an alkylene group having 1 to about 4 carbon atoms), —N($R^5$)—$R^6$—N($R^7$)— ($R^5$ and $R^6$ have the same meanings as described above, and $R^7$ is a hydrogen atom, an alkyl group having 1 to 6 carbon atoms or a substituted alkyl group having 1 to 6 carbon atoms), —O—, —S—, —N($R^5$)—CO—N($R^7$)— ($R^5$ and $R^7$ have the same meanings as described above), —N($R^5$)—$SO_2$—N($R^7$)— ($R^5$ and $R^7$ have the same meanings as described above), —COO—, —OCO—, —N($R^5$)$CO_2$— ($R^5$ has the same meaning as described above) and —N($R^5$)CO— ($R^5$ has the same meaning as described above).

p, q, r and s each represents 0 or 1.

$X^1$, $X^2$ and $X^3$, which may be the same or different, each represents an unsubstituted or substituted alkylene, aralkylene or phenylene group having 1 to 10 carbon atoms. The alkylene group may be straight chain or branched. Examples of the alkylene group include methylene, methyl—methylene, dimethylmethylene, dimethylene, trimethylene, tetramethylene, pentamethylene, hexamethylene and decyl-methylene, and examples of the aralkylene group include benzylidene. Examples of the phenylene group include, for example, p-phenylene, m-phenylene and methylphenylene.

X represents a monovalent group containing an active methylene group, and preferred examples thereof include $R^8$—CO—$CH_2$—COO—, NC—$CH_2$—COO—, $R^8$—CO—$CH_2$—CO— and $R^8$—CO—$CH_2$—CON($R^5$)—, wherein $R^5$ has the same meaning as described above; and $R^8$ represents a substituted or unsubstituted alkyl group, having 1 to 12 carbon atoms (e.g., methyl, ethyl, n-propyl, n-butyl, t-butyl, n-nonyl, 2-methoxyethyl, 4-phenoxybutyl, benzyl or 2-methanesulfonamidoethyl), a substituted or unsubstituted aryl group (e.g., phenyl, p-methyl-phenyl, p-methoxyphenyl or o-chlorophenyl), an alkoxy group (e.g., methoxy, ethoxy, methoxyethoxy or n-butoxy), a cycloalkyloxy group (e.g., cyclohexyloxy), an aryloxy group (e.g., phenoxy, p-methylphenoxy, o-chloro-phenoxy or p-cyanophenoxy), an amino group or a substituted amino group (e.g., methylamino, ethylamino, dimethylamino or butylamino).

Particularly preferred polymer latexes having active methylene groups have the core/shell structure, and the shell portions have active methylene groups. The details of latexes having such core/shell structure are described in Japanese Patent Application No. 7-3296.

Examples of monomers having active methylene groups giving repeating units constituting the shells of the latexes which are preferably used in the present invention are shown below, but the present invention is not limited thereto:

M-1: 2-Acetoacetoxyethyl Methacrylate

M-2: 2-Acetoacetoxyethyl Acrylate

M-3: 2-Acetoacetoxypropyl Methacrylate

M-4: 2-Acetoacetoxypropyl Acrylate

M-5: 2-Acetoacetamidoethyl Methacrylate

M-6: 2-Acetoacetamidoethyl Acrylate

M-7: 2-Cyanoacetoxyethyl Methacrylate

M-8: 2-Cyanoacetoxyethyl Acrylate

M-9: N-(2-Cyanoacetoxyethyl)acrylamide

M-10: 2-Propionylacetoxyethyl Acrylate

M-11: N-(2-Propionylacetoxyethyl)methacrylamide

M-12: N-4-(Acetoacetoxybenzyl)phenylacrylamide

M-13: Ethylacryloyl Acetate

M-14: Acryloylmethyl Acetate

M-15: N-Methacryloyloxymethylacetoacetamide

M-16: Ethylmethacryloyl Acetoacetate

M-17: N-Allylcyanoacetamide

M-18: 2-Cyanoacetylethyl Acrylate

M-19: N-(2-Methacryloyloxymethyl)cyanoacetamide

M-20: p-(2-Acetoacetyl)ethylstyrene

M-21: 4-Acetoacetyl-l-methacryloylpiperazine

M-22: Ethyl-α-acetoacetoxymethacrylate

M-23: N-Butyl-N-acryloyloxyethylacetoacetamide

M-24: p-(2-Acetoacetoxy)ethylstyrene

Preferred examples of the core/shell latex compounds used in the present invention are shown below, but the present invention is not limited thereto. The structure of the following latex compounds is described in the order of the core polymer structure, the shell polymer structure and the core/shell ratio, and all copolymerized composition ratios and core/shell ratios of the respective polymers are % by weight.

P-1 to P-12

Core: Styrene/Butadiene Copolymer (37/63)

P-1: Shell=Styrene/M-1 (98/2), Core/Shell=50/50

P-2: Shell=Styrene/M-1 (96/4), Core/Shell=50/50

P-3: Shell=Styrene/M-1 (92/8), Core/Shell=50/50

P-4: Shell=Styrene/M-1 (84/16), Core/Shell=50/50

P-5: Shell=Styrene/M-1 (68/32), Core/Shell=50/50

P-6: Shell=Styrene/M-1 (84/16), Core/Shell=67/33

P-7: Shell=Styrene/M-1 (84/16), Core/Shell=85/15

P-8: Shell=n-Butyl Acrylate/M-1 (96/4), Core/Shell=50/50

P-9: Shell=n-Butyl Acrylate/M-1 (92/8), Core/Shell=50/50

P-10: Shell=n-Butyl Acrylate/M-1 (84/16), Core/Shell=50/50

P-11: Shell=Methyl Acrylate/M-7 (84/16), Core/Shell=50/50

P-12: Shell=Styrene/Methyl Acrylate/M-3 (21/63/16), Core/Shell=50/50

P-13 and P-14

Core: Styrene/Butadiene Copolymer (22/78)

P-13: Shell=Styrene/M-2 (84/16), Core/Shell=50/50

P-14: Shell=n-Butyl Acrylate/M-8 (84/16), Core/Shell=50/50

P-15 to P-20

Core: Butadiene Homopolymer (100)

P-15: Shell=Styrene/M-1 (84/16), Core/Shell=50/50

P-16: Shell=Ethyl Acrylate/M-7/Methacrylic Acid (65/15/20), Core/Shell=75/25

P-17: Shell=n-Butyl Acrylate/M-1 (84/16), Core/Shell=50/50

P-18: Shell=n-Butyl Acrylate/M-2 (84/16), Core/Shell=50/50

P-19: Shell=2-Ethylhexyl Acrylate/M-24 (84/16), Core/Shell=50/50

P-20: Shell=n-Butyl Acrylate/M-18 (84/16), Core/Shell=50/50

P-21 to P-23

Core: Isoprene Homopolymer (100)

P-21: Shell=Styrene/Acrylonitrile/M-1 (63/21/16), Core/Shell=90/10

P-22: Shell=Methyl Methacrylate/Ethyl Acrylate/M-2/Sodium 2-Acrylamido-2-methylpropanesulfonate (15/65/15/5), Core/Shell=75/25

P-23: Shell=Styrene/M-1 (84/16), Core/Shell=20/80

P-24 to P-26

Core: Styrene/Butadiene Copolymer (49/51)

P-24: Shell=Styrene/Butyl Acrylate/M-1 (25/60/15), Core/Shell=50/50

P-25: Shell=M-1 (100), Core/Shell=90/10

P-26: Shell=Lauryl Methacrylate/Butyl Acrylate/M-7 (30/55/15), Core/Shell=40/60

P-27

Core: Acrylonitrile/Styrene/Butadiene Copolymer (25/25/50)

Shell: Butyl Acrylate/M-1 ( 92/8), Core/Shell=50/50

P-28

Core: Ethyl Acrylate/Butadiene Copolymer (50/50)

Shell: Styrene/Divinylbenzene/M-1 (79/5/16), Core/Shell=50/50

P-29 to P-33

Core: n-Dodecyl Methacrylate Homopolymer

P-29: Shell=Styrene/M-1 (92/8), Core/Shell=50/50

P-30: Shell=Styrene/M-1 (84/16), Core/Shell=50/50

P-31: Shell=Ethyl Acrylate/M-1 (96/4), Core/Shell=50/50

P-32: Shell=Ethyl Acrylate/M-1 (92/8), Core/Shell=50/50

P-33: Shell=Styrene/Methyl Acrylate/M-3 (21/63/16), Core/Shell=50/50

P-34

Core: n-Butyl Acrylate Homopolymer

Shell: Styrene/M-2 (84/16), Core/Shell=50/50

P-35 and P-36

Core: Ethylene Glycol Dimethacrylate/n-Butyl Acrylate Copolymer (10/90)

P-35: Shell=Styrene/M-1 (84/16), Core/Shell=50/50

P-36: Shell=Methyl Acrylate/M-7/Methacrylic Acid (65/15/20), Core/Shell=75/25

P-37 to P-40

Core: Ethylene Glycol Dimethacrylate/n-Butyl Acrylate Copolymer (20/80)

P-37: Shell=Styrene/M-1 (84/16), Core/Shell=50/50

P-38: Shell=Styrene/M-1 (84/16), Core/Shell=75/25

P-39: Shell=Methyl Acrylate/M-8/Sodium 2-Acrylamido-2-methylpropanesulfonate (80/15/5), Core/Shell=75/25

P-40: Shell=n-Butyl Acrylate/M-1 (84/16), Core/Shell=50/50

P-41 to P-43

Core: Vinyl Acetate Homopolymer (100)

P-41: Shell=Styrene/M-1 (84/16), Core/Shell=50/50

P-42: Shell=Styrene/Divinylbenzene/M-24 (79/5/16), Core/Shell=50/50

P-43: Shell=n-Dodecyl Methacrylate/Butyl Acrylate/M-7 (30/55/15), Core/Shell=40/60

P-44 to P-46

Core: Divinylbenzene/2-Ethylhexyl Acrylate Copolymer (10/90)

P-44: Shell=Methyl Acrylate/M-1 (84/16), Core/Shell=50/50

P-45: Shell=Methyl Acrylate/Styrene/M-1 (74/10/16), Core/Shell=50/50

P-46: Shell=M-1 (100), Core/Shell=90/10

P-47 to P-49

Core: Divinylbenzene/Styrene/2-Ethylhexyl Acrylate Copolymer (10/23/67)

P-47: Shell=Methyl Acrylate/M-1 (84/16), Core/Shell=50/50

P-48: Shell=Methyl Acrylate/Styrene/M-1 (74/10/16), Core/Shell=50/50

P-49: Shell=Ethyl Acrylate/2-Hydroxyethyl Methacrylate/M-5 (65/15/20), Core/Shell=85/15

P-50

Core: Ethylene Glycol Dimethacrylate/Vinyl Palmitate/n-Butyl Acrylate Copolymer (20/20/60)

Shell: Ethylene Glycol Dimethacrylate/Styrene/n-Butyl Methacrylate/M-1 Copolymer (5/40/40/15), Core/Shell=50/50

P-51

Core: Trivinylcyclohexane/n-Butyl Acrylate/Styrene Copolymer (10/55/35)

Shell: Methyl Acrylate/M-1/Sodium 2-Acrylamido-2-methylpropanesulfonate (88/7/5), Core/Shell=70/30

P-52 and P-53

Core: Divinylbenzene/Styrene/Methyl Methacrylate Copolymer (10/45/45)

P-52: Shell=n-Butyl Acrylate/M-1 (84/16), Core/Shell=50/50

P-53: Shell=n-Dodecyl Acrylate/Ethyl Acrylate/M-21 (60/30/10), Core/Shell=50/50

P-54 and P-55

Core: p-Vinyltoluene/n-Dodecyl Methacrylate Copolymer (70/30)

P-54: Shell=Methyl Acrylate/n-Butyl Methacrylate/M-2/Acrylic Acid (30/55/10/5), Core/Shell=50/50

P-55: Shell=n-Butyl Acrylate/M-19 (84/16), Core/Shell=70/30

In the present invention, silver halide emulsions used for the silver halide photographic material can contain a mixed silver halide such as silver chlorobromide, silver iodobromide and silver chloroiodobromide, as well as silver chloride and silver bromide, as silver halides. Silver chlorobromide and silver iodochlorobromide containing 50 mol % or more of silver chloride are preferably used. The content of silver iodide is preferably 3 mol % or less, and more preferably 0.5 mol % or less. The form of silver halide grains may be any of cubic, octahedral, tetradecahedral, irregular and tabular forms, but the cubic form is preferred. The mean grain size of the silver halide grains is preferably 0.01 μm to 0.7 μm, and more preferably 0.05 μm to 0.5 μm. The silver halide grains having narrow distribution of grain size which have a fluctuation coefficient represented by (standard deviation of grain size/mean grain size)×100 of 15% or less, more preferably 10% or less, are preferably used.

The silver halide grain may have uniform phases or different phases in the inside and a surface layer thereof.

The photographic emulsion which can be used in the present invention can be prepared according to the methods described in P. Glafkides, *Chimie et Physique Photographique* (Paul Montel, 1967), G. F. Duffin, *Photographic Emulsion Chemistry* (The Focal Press, 1966) and V. L. Zelikman et al., *Making and Coating Photographic Emulsion* (The Focal Press, 1964).

A soluble silver salt and a soluble halogen salt may be reacted with each other by any of a single jet process, a double jet process and a combination thereof.

A so-called reverse mixing process in which grains are formed in the presence of excess silver ions can also be used. As a type of double jet process, there can also be used a process for maintaining the pAg of a liquid phase where a silver halide is formed constant, namely a so-called controlled double jet process. Further, it is preferred that the grains are formed by use of a silver halide solvent such as ammonia, thioethers and four-substituted thiourea compounds. The four-substituted thiourea compounds, which are described in JP-A-53-82408 and JP-A-55-77737, are more preferably used. Preferred examples of the thiourea compound include 1,3-dimethyl-2-imidazolidinethione.

According to the controlled double jet process and the grain formation process using the silver halide solvent, a silver halide emulsion having a regular crystal form and a narrow grain size distribution can be easily prepared. These processes are therefore useful means for preparing the silver halide emulsion used in the present invention.

In order to obtain the grains having uniform grain size, it is preferred that the grains are allowed to rapidly grow within the range not exceeding the critical saturation using the method of varying the addition rate of silver nitrate or alkali halides according to the growth rate of the grains as described in British Patent 1,535,016, JP-B-48-36890 and JP-B-52-16364, or the method of changing the concentration of aqueous solutions as described in British Patent 4,242,445 and JP-A-55-158124.

The silver halide emulsions used in the present invention are preferably subjected to chemical sensitization, and known methods such as sulfur sensitization, selenium sensitization, tellurium sensitization and noble metal sensitization can be used alone or in combination. When they are used in combination, for example, sulfur sensitization and gold sensitization; sulfur sensitization, selenium sensitization and gold sensitization; and sulfur sensitization, tellurium sensitization and gold sensitization are preferred.

The sulfur sensitization used in the present invention is usually conducted by adding a sulfur sensitizer and stirring an emulsion at a high temperature of 40° C. or more for a definite period of time. As the sulfur sensitizers, known compounds can be used. Examples thereof include various sulfur compounds such as thiosulfates, thiourea compounds, thiazole compounds and rhodanine compounds, as well as sulfur compounds contained in gelatin. Preferred sulfur compounds are thiosulfates and thiourea compounds. Although the amount of the sulfur sensitizer varies depending on various conditions such as the pH and the temperature in chemical ripening and the size of silver halide grains, it is preferably from $10^{-7}$ to $10^{-2}$ mol per mol of silver halide, and more preferably from $10^{-5}$ to $10^{-3}$ mol per mol.

As selenium sensitizers used in the present invention, known selenium compounds can be used. That is, the selenium sensitization is usually conducted by adding an unstable type and/or non-stable type selenium compound and stirring an emulsion at a high temperature, preferably at 40° C. or more, for a definite period of time. As the unstable type selenium compounds, there can be used compounds described in JP-B-44-15748, JP-B-43-13489, JP-A-4-25832, JP-A-4-109240, JP-A-4-324855, etc. In particular, compounds represented by formulas (VIII) and (IX) in JP-A-4-324855 are preferably used.

Tellurium sensitizers are compounds producing silver telluride presumed to form a sensitizing nucleus in the surface or the inside of a silver halide grain. The forming rate of silver telluride in the silver halide emulsion can be tested by the method described in Japanese Patent Application No. 4-146739.

Specifically, there can be used compounds described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-4-333043, JP-A-4-129787, *J. Chem. Soc. Chem. Commnun.*, 635 (1980), ibid., 1102 (1979), ibid., 645 (1979), *J. Chem. Soc. Perkin. Trans.*, 1, 2191 (1980), *The Chemistry of Organic Selenium and Tellurium Compounds*, vol. 1, edited by S. Patai (1986) and ibid. vol. 2 (1987). In particular, compounds represented by formulas (II), (III) and (IV) in Japanese Patent Application No. 4-146739 are preferably used.

Although the amount of the selenium and tellurium sensitizers used in the present invention varies depending on silver halide grains used, chemical ripening conditions, etc., it is generally $10^{-8}$ to $10^{-2}$ mol per mol of silver halide, and preferably about $10^{-7}$ to $10^{-3}$ mol per mol. There is no particular limitation on the chemical ripening conditions in the present invention. However, the pH is 5 to 8, the pAg is 6 to 11 and preferably 7 to 10, and the temperature is 40° to 95° C. and preferably 45° to 85° C.

Examples of the noble metal sensitizer which can be used in the present invention include gold, platinum and palladium, and particularly gold sensitization is preferred. Examples of the gold sensitizer include chloroauric acid, potassium chloroaurate, potassium aurithiocyanate and gold sulfide. The noble metal sensitizer can be used in an amount of about $10^{-7}$ to $10^{-2}$ mol per mol of silver halide.

In the course of formation of the silver halide grains and physical ripening, cadmium salts, sulfites, lead salts, thallium salts, etc. may be allowed to coexist with the silver halide emulsion.

In the present invention, reduction sensitization can be used. As reduction sensitizers, stannous salts, amines, formamidinesulfinic acid, silane compounds, etc. can be used.

By the method shown in European Patent 293,917, thiosulfonic acid compounds may be added to the silver halide emulsion.

The silver halide emulsion to be contained in the photographic material may be used alone or in combination of two or more (for example, emulsions different in mean grain size, emulsions different in halogen composition, emulsions different in crystal habit, and emulsions different in chemical ripening conditions).

The silver halide photographic material of the present invention preferably contains a rhodium compound in order to achieve high contrast and low fog.

As the rhodium compound, water-soluble rhodium compounds can be used. Examples thereof include rhodium (III) halide compounds or rhodium complex salts having halogens, amines, oxalato or the like as ligands, for example, hexachloro-rhodium (III) complex salts, hexabromorhodium (III) complex salts, hexaaminerhodium (III) complex salts and trioxalatorhodium (III) complex salts. The rhodium compound is dissolved in water or an appropriate solvent. In order to stabilize the solution of the rhodium compound, a method generally frequently used, that is, the method of adding an aqueous solution of a hydrogen halide (for example, hydrochloric acid, hydrobromic acid or hydrofluoric acid) or an alkali halide (e.g., KCl, NaCl, KBr or NaBr) can be used. Instead of use of the water-soluble rhodium compound, it is also possible to add and dissolve other silver halide grains previously doped with rhodium in preparing the silver halide.

The total amount of the rhodium compound is generally from $1\times10^{-8}$ to $5\times10^{-6}$ mol per mol of silver halide finally formed, and preferably from $5\times10^{-8}$ to $1\times10^{-6}$ mol per mol.

Addition of these compounds can be appropriately conducted in preparing the silver halide emulsion grains and in each step prior to coating of the emulsions. In particular, the compounds are preferably added during the formation of the emulsion to incorporate them into the silver halide grains.

The silver halide photographic material of the present invention preferably contains an iridium compound in order to achieve high sensitivity and high contrast.

As the iridium compound, various compounds can be used in the present invention. Examples thereof include hexachloroiridium, hexamineiridium, trioxalatoiridium and hexacyanoiridium. The iridium compound is dissolved in water or an appropriate solvent. In order to stabilize the solution of the iridium compound, a method generally frequently used, that is, the method of adding an aqueous solution of a hydrogen halide (e.g., hydrochloric acid, hydrobromic acid or hydrofluoric acid) or an alkali halide (e.g., KCl, NaCl, KBr or NaBr) can be used. Instead of use of the water-soluble iridium compound, it is also possible to add and dissolve other silver halide grains previously doped with iridium in preparing the silver halide.

The total amount of the iridium compound is generally from $1\times10^{-8}$ to $5\times10^{-6}$ mol per mol of silver halide finally formed, and preferably from $5\times10^{-8}$ to $1\times10^{-6}$ mol per mol.

Addition of these compounds can be appropriately conducted in preparing the silver halide emulsion grains and in each step prior to coating of the emulsions. In particular, the compounds are preferably added in forming the emulsions to incorporate them into the silver halide grains.

The silver halide grains used in the present invention may contain metal atoms such as iron, cobalt, nickel, ruthenium, palladium, platinum, gold, thallium, copper, lead and osmium. The above-mentioned metals are preferably contained in an amount of $1\times10^{-9}$ to $1\times10^{-4}$ mol per mol of silver halide. When the above-mentioned metal is added, it can be added in the form of single salts, double salts or complex salts in preparing the grains.

Contact films and contact paper which can be handled in illuminated rooms are generally called bright room light-type photographic materials for contact work, and silver chloride emulsions are preferably used in such photographic materials.

The developing solution to be used in the present invention is described below.

A developing solution contains at least ascorbic acid or a derivative thereof as a developing agent. A compound represented by formula (II) is preferably used as ascorbic acid or the derivative thereof.

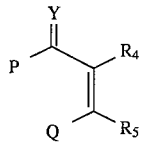

(II)

In formula (II), $R_4$ and $R_5$ each represents a hydroxyl group, an amino group (including a group having an alkyl group with 1 to 10 carbon atoms as a substituent, for example, methyl, ethyl, n-butyl or hydroxyethyl), an acylamino group (such as acetylamino or benzoylamino), an alkylsulfonylamino group (such as methanesulfonylamino), an arylsulfonylamino group (such as benzenesulfonylamino or p-toluenesulfonylamino), an alkoxycarbonylamino group (such as methoxycarbonylamino), a mercapto group or an alkylthio group (such as methylthio or ethylthio). Preferred examples of $R_4$ and $R_5$ include a hydroxyl group, an amino group, an alkylsulfonylamino group and an arylsulfonylamino group.

P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxy group or a mercapto group, or P and Q represent atomic groups necessary for formation of a 5-, 6- or 7-membered ring together with two vinyl carbon atoms each having $R_4$ or $R_5$ as a substituent and a carbon atom having Y as a substituent.

In the case that P and Q are not combined with each other, P and Q each preferably represents a group having 1 to 8 carbon atoms. It is preferred that at least one of P and Q has 1 to 8 carbon atoms.

Examples of the ring structure which P and Q are combined to form together with two vinyl carbon atoms each having $R_4$ or $R_5$ and a carbon atom having Y include those composed of any combination selected from the group consisting of —O—, —C($R_7$)($R_8$)—, —C($R_9$)=, —C(=O)—, —N($R_{10}$)—, and —N=, wherein $R_7$, $R_8$, $R_9$ and $R_{10}$ each represents a hydrogen atom, an alkyl group having 1 to 10 carbon atoms which may be substituted (substituents include hydroxyl, carboxyl and sulfo groups), a hydroxyl group or a carboxyl group. Further, the 5- to 7-membered ring may be condensed to form saturated or unsaturated condensed ring.

Examples of the 5- to 7-membered ring include dihydrofuranone rings, dihydropyrone rings, pyranone rings, cyclopentenone rings, cyclohexenone rings, pyrrolinone rings, pyrazolinone rings, pyridone rings, azacyclohexenone rings and uracil rings. Preferred examples thereof include dihydrofuranone rings, cyclopentenone rings, cyclohexenone rings, pyrazolinone rings, azacyclohexenone rings and uracil rings.

Y represents =O or =N—$R_6$, wherein $R_6$ represents a hydrogen atom, a hydroxyl group, an alkyl group (e.g., methyl or ethyl), an acyl group (e.g., acetyl), a hydroxyalkyl group (e.g., hydroxymethyl or hydroxyethyl), a sulfoalkyl group (e.g., sulfomethyl or sulfoethyl) or a carboxyalkyl group (e.g., carboxymethyl or carboxyethyl).

Examples of the compound represented by formula (II) are shown below, but the present invention is not limited thereto:

II-1

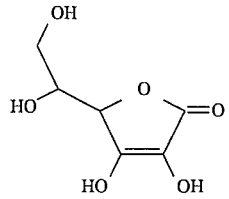

II-2

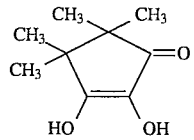

II-3

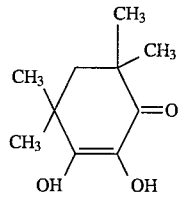

II-4

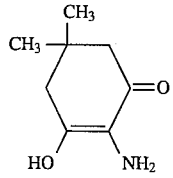

II-5

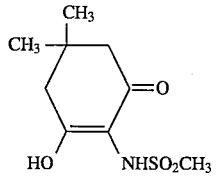

II-6

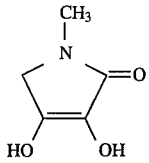

II-7

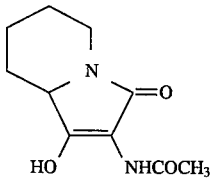

II-8

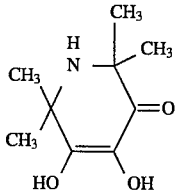

-continued
II-9
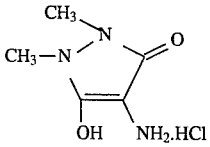
II-10
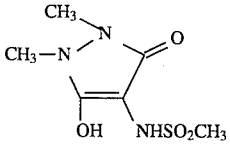
II-11
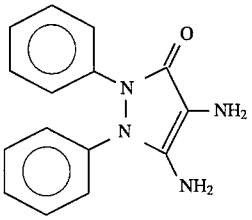
II-12
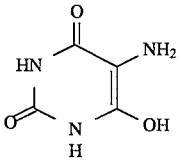
II-13
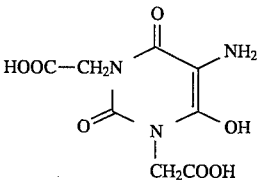
II-14
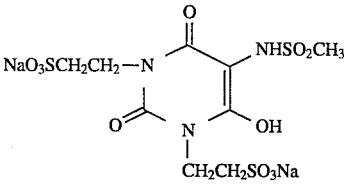
II-15
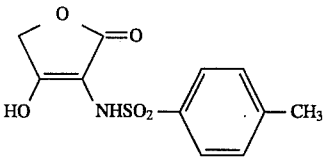
II-16
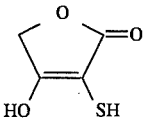
II-17
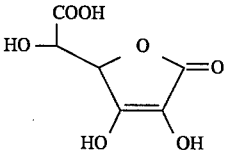
-continued
II-18
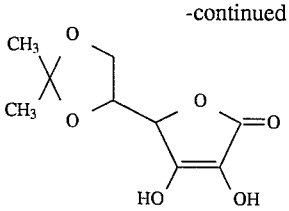
II-19
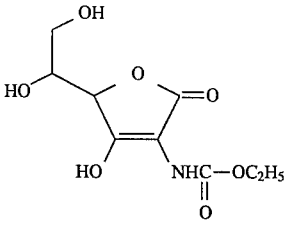
II-20
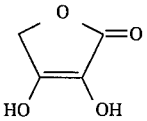
II-21
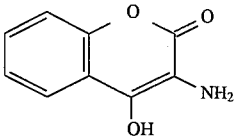
II-22
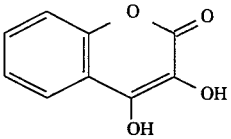
II-23
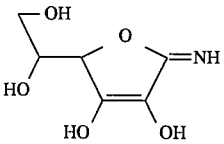
II-24
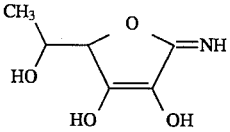
II-25
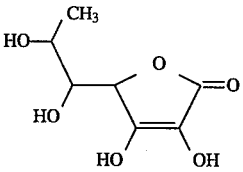
II-26
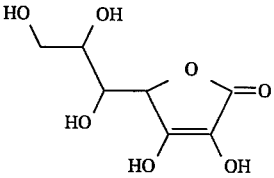
II-27
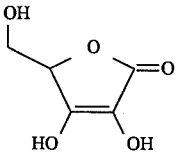

-continued

II-28

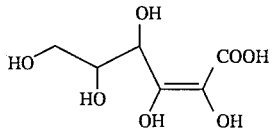

II-29

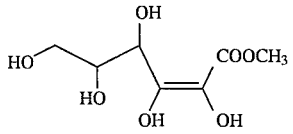

II-30

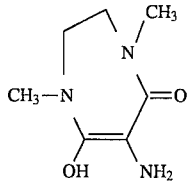

II-31

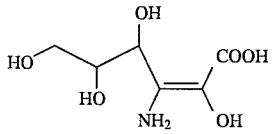

Of these, ascorbic acid and erythorbic acid (a diastereomer of ascorbic acid) are preferred.

The compound represented by formula (II) is used generally in an amount of $5\times10^{-3}$ to 1 mol per liter of the developing solution, and preferably in an amount of $10^{-2}$ to 0.5 mol per liter.

It is preferred that the developing solution contains an auxiliary developing agent.

As the auxiliary developing agent, there can be used, 3-pyrazoline compound, phenylenediamine compounds and aminophenol compounds. Examples of the 3-pyrazolidone compounds include 1-phenyl-3-pyrazolidone, 1-phenyl-4-methyl-3-pyrazolidone, 1-phenyl-5-methyl-3-pyrazolidone, 1-phenyl-4-ethyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone, 3-acetoxy-1-phenyl-3-pyrazolidone, 3-aminopyrazoline compounds such as 1-(p-hydroxyphenyl)-3-aminopyrazoline, 1-(p-methylaminophenyl)-3-aminopyrazoline and 1-(p-amino-m-methylphenyl)-3-aminopyrazoline. Examples of the phenylenediamine compound include, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 3-methyl-4-amino-N-ethyl-N-β-methoxyethylaniline. Examples of the aminophenol compound include 4-aminophenol, 4-amino-3-methylphenol, 4-(N-methyl)aminophenol, 2,4-diaminophenol, N-(4-hydroxyphenyl)glycine, N-(2'-hydroxyethyl)-2-aminophenol, 2-hydroxymethyl-4-aminophenol, 2-hydroxymethyl-4-(N-methyl)aminophenol, hydrochlorides and sulfates thereof.

The auxiliary developing agent is used generally in an amount of $5\times10^{-4}$ to 0.5 mol per, liter of the developing solution, and preferably in an amount of $10^{-3}$ to 0.1 mol per liter.

The developing solution preferably contains hydroquinonemonosulfonic acid or derivatives thereof. In this case, the developing solution contains three components, the ascorbic acid compound, the hydroquinonemonosulfonic acid compound and the auxiliary developing agent.

The developing solution is substantially free from unsubstituted hydroquinone. This means that the developing solution does not contain unsubstitued hydroquinone at all or in such an amount that unsubstituted hydroquinone affects photographic performance (such as contrast and sensitivity) of the photographic material.

The developing solution preferably contains a preservative and an alkali, besides the above-mentioned indispensable component. As the preservative, sulfites can be used. The sulfites include sodium sulfite, potassium sulfite, lithium sulfite, ammonium sulfite, sodium bisulfite, potassium bisulfite and potassium metabisulfite.

An increase in the amount of the preservative improves the preservability of the developing solution, while it increases the amount of silver ions eluted from the photographic material into the developing solution. There is therefore the adverse effect of gradually accumulating silver sludge in the developing solution. The developing solution to be used in the present invention can obtain the sufficient preservability because of their high stability even if the sulfites are added in a smaller amount. Accordingly, the sulfites are added preferably in an amount of 0.5 mol or less per liter of developing solution, and more preferably in an amount of 0.03 to 0.3 mol per liter.

The pH of the developing solution to be used in the present invention is from 8.5 to 11.0, and preferably from 9.0 to 10.5.

As the alkali agent which can be used for controlling the pH value within the range, there can be used ordinary water-soluble inorganic alkali metal salts such as sodium hydroxide, potassium hydroxide, lithium hydroxide, sodium carbonate and potassium carbonate.

Additives used in addition to the above include a development inhibitor such as sodium bromide and potassium bromide; an organic solvent such as ethylene glycol, diethylene glycol, triethylene glycol and dimethylformamide; development accelerators such as alkanolamines (e.g., diethanolamine and triethanolamine), and imidazole or a derivative thereof; and an antifoggant or a black pepper inhibitor such as mercapto compounds, indazole compounds, benzotriazole compounds and benzoimidazole compounds. Examples thereof include 5-nitroindazole, 5-p-nitrobenzoylaminoindazole, 1-methyl-5-nitroindazole, 6-nitroindazole, 3-methyl-5-nitroindazole, 5-nitrobenzindazole, 2-isopropyl-5-nitrobenzimidazole, nitrobenzotriazole, sodium 4-[(2-mercapto-l,3,4-thiadiazole-2-yl)thio]butanesulfonate, 5-amino-l,3,4-thiadiazole-2-thiol, methylbenzotriazole, 5-methylbenzotriazole and 2-mercaptobenzotriazole. The amount of the antifoggant is usually 0.01 to 10 mmol per liter of the developing solution, and more preferably 0.05 to 2 mmol per liter.

Further, the developing solution may contain various kinds of organic and inorganic chelating agents in combination. Examples of the inorganic chelating agent include sodium tetrapoly-phosphate and sodium hexametaphosphate. Examples of the organic chelating agent include organic carboxylic acids, aminopoly-carboxylic acids, organic phosphonic acids, aminophosphonic acids and organic phosphonocarboxylic acids.

The organic carboxylic acids include but are not limited to acrylic acid, oxalic acid, malonic acid, succinic acid, glutaric acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid and tartaric acid.

Examples of the aminopolycarboxylic acid include iminodiacetic acid, nitrilotriacetic acid, nitrilotripropionic acid ethylenediaminemonohydroxy-ethyltriacetic acid, ethylenediaminetetra-acetic acid, glycolethertetraacetic acid, 1,2-diaminopropane-tetraacetic acid, diethylenetriaminepentaacetic acid, triethylenetetraminehexaacetic acid, 1,3-diamino-2-propanoltetraacetic acid, glycoletherdiaminetetraacetic acid and compounds described in JP-A-52-25632, JP-A-55-67747, JP-A-57-102624 and JP-B-53-40900.

Examples of the organic phosphonic acid include hydroxyalkylidene-diphosphonic acids described in U.S. Pat. Nos. 3,214,454 and 3,794,591 and West German Patent (OLS) 2,227,639, and compounds described in *Research Disclosure.,* 181, Item 18170 (May, 1979).

Examples of the aminophosphonic acid include compounds described in *Research Disclosure,* 18170 described above, JP-A-57-208554, JP-A-54-61125, JP-A-55-29883 and JP-A-56-97347, as well as aminotris(methylenephosphonic acid), ethylenediaminetetramethylenephosphonic acid and aminotrimethylenephosphonic acid.

Examples of the organic phosphonocarboxylic acid include compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure,* 18170 described above.

These chelating agents may be used in the form of alkali metal salts or ammonium salts. The amount of these chelating agents added is preferably $1\times10^{-4}$ to $1\times10^{-1}$ mol per liter of the developing solution, and more preferably $1\times10^{-3}$ to $1\times10^{-2}$ mol per liter.

The developing solution may further contain a color toning agent, a surfactant, an antifoaming agent and a hardening agent, if desired.

The developing solution can contain a buffer such as carbonates, boric acid and borates (e.g., boric acid, borax, sodium metaborate and potassium borate), saccharides described in JP-A-60-93433 (e.g., saccharose), oximes (e.g., acetoxime), phenols (e.g., 5-sulfosalicylic acid), tertiary phosphates (e.g., the sodium salt and the potassium salt) and aluminates (e.g., the sodium salt). Preferred examples thereof include carbonates and borates.

The processing temperature and time are related to each other, and determined with reference to the whole processing time. The processing temperature is generally about 20° C. to about 50° C., and preferably 25° C. to 45° C., and the processing time is 5 seconds to 2 minutes, and preferably 7 seconds to 1 minute and 30 seconds.

When one meter square of a silver halide black-and-white photographic material is processed, the volume of the developing solution to be replenished is 500 ml or less, and preferably 400 ml or less.

For the purpose of reducing transport costs of processing solutions, packaging material costs and space, it is preferred that the processing solution is concentrated and diluted at the time of use. In order to concentrate the developing solution, it is effective that salt components contained in the developing solution are potassium salts.

A fixing solution which can be used in a fixing step is an aqueous solution which contains sodium thiosulfate or ammonium thiosulfate, and, if desirable, may contain tartaric acid, citric acid, gluconic acid, boric acid, iminodiacetic acid, 5-sulfo-salicylic acid, glucoheptanoic acid, Tiron, ethylenediamine-tetraacetic acid, diethylenetriaminepentaacetic acid, and nitrilotriacetic acid or salts thereof. From the recent viewpoint of environmental conservation, it is preferred that boric acid is not contained.

Fixing agents of the fixing solutions used in the present invention are sodium thiosulfate, ammonium thiosulfate, etc., and ammonium thiosulfate is preferred in terms of fixing rate. However, from the recent viewpoint of environmental conservation, sodium thiosulfate is preferred. The amount of these known fixing agents used can be appropriately changed, and it is generally about 0.1 to about 2 mol/liter and particularly preferably 0.2 to 1.5 mol/liter.

The fixing solution can contain a hardening agent (e.g., water-soluble aluminum compounds), a preservative (e.g., sulfites and bisulfites), a pH buffer (e.g., acetic acid), a pH regulator (e.g., ammonium and sulfuric acid), a chelating agent, a surfactant, a wetting agent and a fixing accelerator, if desired.

Examples of the surfactant include an anionic surfactant such as sulfated compounds and sulfonated compounds, a polyethylene surfactant, and an amphoteric surfactant described in JP-A-57-6740. Further, known antifoaming agents may be added. Examples of the wetting agent include alkanol-amines and alkylene glycols. Examples of the fixing accelerator include thiourea derivatives described in JP-B-45-35754, JP-B-58-122535 and JP-B-58-122536, alcohols having triple bonds in their molecules, thioether compounds described in U.S. Pat. No. 4,126,459 and mesoionic compounds described in JP-A-4-229860. Further, compounds described in JP-A-2-44355 may also be used.

Examples of the pH buffer include an organic acid such as acetic acid, malic acid, succinic acid, tartaric acid, citric acid, oxalic acid, maleic acid, glycolic and adipic acid, and inorganic buffers such as boric acid, phosphates and sulfites. Acetic acid, tartaric acid and sulfites are preferably used.

The pH buffer is used to prevent the pH of the fixing solution from increasing due to introduction of the developing solution, and used in an amount of 0.01 to 1.0 mol/liter, and more preferably in an amount of 0.02 to 0.6 mol/liter.

The pH of the fixing solution is preferably from 4.0 to 6.5, and more preferably from 4.5 to 6.0.

Further, as a dye elution accelerator, compounds described in JP-A-64-4739 can also be used.

Examples of the hardening agent which can be incorporated in the fixing solution include water-soluble aluminum salts and chromium salts. Water-soluble aluminum salts are preferably used, and examples thereof include aluminum chloride, aluminum sulfate and potassium alum. The added amount is preferably from 0.01 mol to 0.2 mol/liter, and more preferably from 0.03 mol to 0.08 mol/liter.

The fixing temperature is about 20° C. to about 50° C., and preferably about 25° C. to 45° C., and the fixing time is 5 seconds to 1 minute, and preferably 7 seconds to 50 seconds.

The replenishment rate of the fixing solution is 600 ml/$m^2$ or less based on the amount of photographic material processed, and preferably 500 ml/$m^2$ or less.

The photographic material which has been developed and fixed is then subjected to washing and stabilization processing.

Washing or stabilization processing is conducted in a washing water amount of 20 liters or less per $m^2$ of silver halide photographic material, and can also be conducted at a replenishment rate of 3 liters or less (including 0, namely pool washing). That is, not only water-saving processing becomes possible, but also piping for installation of an automatic processor can be made unnecessary.

As a method for decreasing the replenishment rate of washing water, a multi-stage countercurrent system (e.g., two-stage, three-stage, etc.) has been known for long. When this multi-stage countercurrent system is applied to the present invention, the photographic material after fixing is gradually processed in a normal direction, namely it successively comes into contact with a processing solution not contaminated with a fixing solution, which results in more efficient washing.

When washing is carried out with a small amount of water, it is more preferred to provide washing tanks of squeeze rolls and crossover rolls described in JP-A-63-18350, JP-A-62-287252, etc. In order to reduce environmental pollution load which raises a problem in washing with a small amount of water, addition of various oxidizing agents and filtration through filters may be combined with each other.

Moreover, in the method of the present invention, an overflowed solution from a washing or stabilizing bath produced by replenishing water subjected to antifungal treatment to the washing or stabilizing bath depending on processing can also be partly or wholly utilized as a processing solution having fixing ability in the preceding processing step as described in JP-A-60-235133.

Further, in order to prevent foam spots which is liable to occur in washing with a small amount of water, and/or to prevent components of processing agents adhered to the squeeze rolls from being transferred to processed films, water-soluble surfactants or antifoaming agents may be added.

Furthermore, for prevention of contamination caused by dyes eluted from the photographic materials, dye adsorbents described in JP-A-63-163456 may be added to washing tanks.

Moreover, the above-mentioned washing processing is followed by stabilization processing in some cases. As an example thereof, baths containing compounds described in JP-A-2-201357, JP-A-2-132435, JP-A-l-102553 and JP-A-46-44446 may be used as the final bath for the photographic material.

Ammonium compounds, compounds of metals such as Bi and Al, fluorescent whitening agents, various chelating agents, membrane pH regulators, hardening agents, disinfectants, antifungal agents, alkanolamines or surfactants can also be added to the stabilizing bath. As water used in the washing step or the stabilization step, there are preferably used deionized water and water sterilized with a halogen or ultraviolet germicidal lamp or various oxidizing agents (ozone, hydrogen peroxide, chlorates, etc.), as well as service water. Washing water containing compounds described in JP-A-4-39652 and JP-A-5-241309 may also be used.

The temperature of the washing or stabilization bath is preferably 0° C. to 50° C., and the processing time is preferably 5 seconds to 2 minutes.

The processing solutions which can be used in the present invention are preferably stored by use of wrapping material having low oxygen permeability described in JP-A-61-73147. The processing solutions may be powdered and solidified by known methods. Preferred examples of such methods include those described in JP-A-61-259921, JP-A-4-85533 and JP-A-4-16841, with those described in JP-A-61-259921 being particularly preferred.

When the replenishment rate is reduced, it is preferred to prevent evaporation and air oxidation of the solution by decreasing the contact area of the processing tank with air. Roller transfer type automatic processors are described in U.S. Pat. Nos. 3,025,779 and 3,545,971, etc., and briefly referred to as roller transfer type processors in this specification. The roller transfer type processor comprises the four steps of development, fixing, washing and drying. It is most preferred that the methods of the present invention also follow these four steps, although not excluding another step (e.g., a stop step). Four steps having a stabilization step in place of the washing step may be used.

There is no particular limitation on various additives and processing methods which are used for the photographic materials according to the present invention. For example, ones described in the following portions can be preferably used.

| Item | Corresponding Portion |
|---|---|
| 1) Nucleating Accelerators | JP-A-2-103536, page 9, upper right column, line 13 to page 16, upper left column, line 10, compounds represented by general formulas (II-m) to (II-p) and exemplary compounds II-1 to II-22; and compounds described in JP-A-1-179939 |
| 2) Silver Halide Emulsion and the Preparation Thereof | JP-A-2-97937, pages 20, lower right column, line 12 to page 21, lower left column, line 14; JP-A-2-12236, page 7, upper right column, line 19 to page 8, lower right column, line 12; and selenium sensitization described in JP-A-5-11389 |
| 3) Spectrally Sensitizing Dyes | Spectral sensitizing dyes described in JP-A-2-12236, page 8, lower left column, line 13 to lower right column, line 4; JP-A-2-103536, page 16, lower right column, line 3 to page 17, lower left column, line 20; JP-A-1-112235, JP-A-2-124560, JP-A-3-7925, JP-A-5-11389; Japanese Patent Application Nos. 6-103272 and 411064 |
| 4) Surfactants | JP-A-2-12236, page 9, upper right column, line 7 to lower right column, line 7; JP-A-2-18542, page 2, lower left column, line 13 to page 4, lower right column, line 18; and Japanese Patent Application No. 5-204325 |
| 5) Antifoggants | Thiosulfinic acid compounds described in JP-A-2-103536, page 17, lower right column, line 19 to page 18, upper right column, line 4 and page 18, lower right column, line 1 to line 5; and JP-A-1-237538 |
| 6) Polymer Latexes | JP-A-2-103536, page 18, lower left column, line 12 to line 20 |
| 7) Compounds Having Acid Groups | JP-A-2-103536, page 18, lower right column, line 6 to page 19, upper left column, line 1 |
| 8) Matte Agents Lubricants Plasticizers | JP-A-2-103536, page 19, upper left column, line 15 to upper right column, line 15 |
| 9) Hardening Agents | JP-A-2-103536, page 18, upper right column, line 5 to line 17 |
| 10) Dyes | Dyes described in JP-A-2-103536, page 17, lower right column, line 1 to line 18; and solid dyes described in JP-A-2-294638 and JP-A-5-11382 |
| 11) Binders | JP-A-2-18542, page 3, lower right column, line 1 to line 20 |
| 12) Black Pepper Inhibitor | Compounds described in U.S. Pat. No. 4,956,257 and JP-A-1-118832 |
| 13) Monomethine Compounds | Compounds of general formula (II) of JP-A-2-287532 (particularly exemplary compounds II-1 to II-26) |
| 14) Dihydroxybenzenes | Descriptions in JP-A-3-39948, |

-continued

| Item | Corresponding Portion |
|---|---|
| | page 11, upper left column to page 12, lower left column; and compounds described in EP-452,772A |
| 15) Developing Solution Developing Methods | JP-A-2-103536, page 19, upper right column, line 16 to page 21, upper left column, line 8 |

The present invention is hereinafter described in more detail by reference to examples. However, the present invention is not limited thereto.

EXAMPLE 1

Preparation of Support

The styrenic polymer produced in Production Example 1 was dried at 150° C. under reduced pressure, followed by pelletizing by use of a single-screw extruder equipped with a vent. The resulting pellets were crystallized with stirring in hot air at 130° C. The content of styrene monomers contained in the crystallized pellets was 1,100 ppm.

Then, the pellets were extruded through an extruder having a built-in filter and provided with a T-die at a nose thereof. At this time, the melting temperature was 300° C.

The sheet in the melted form was formed to a 1400-μm thick transparent sheet having a degree of crystallinity of 9% by the electrostatic close contact method.

The resulting sheet was longitudinally oriented at a ratio of 3.5 at 110° C., and laterally at a ratio of 4 at 120° C., followed by heat treatment at 240° C. in a fixedly tensioned state for 10 seconds and under 5%-restrictive contraction for 20 seconds. The resulting film had a thickness of 100 μm and a haze of 1.0%.

Both surfaces of the resulting SPS support are subjected to glow discharge treatment under the following conditions.

Four 2-cm diameter, 150-cm long cylindrical electrodes each having a hollow portion acting as a refrigerant passage were fixed on an insulated plate at intervals of 10 cm, and this electrode plate was fixed in a vacuum tank. The biaxial oriented film was run so as to face surfaces of the electrodes, 15 cm apart therefrom, and the speed was controlled so that surface treatment was conducted for 2 seconds.

A 50-cm diameter heat roll equipped with a temperature controller was disposed just ahead of the point at which the film passed the electrode so that the film came into contact with the heat roll by ¾ turn, and a thermocouple thermometer was brought into contact with the film surface between the heat roll and an electrode zone, thereby controlling the film surface temperature to 115° C.

The pressure in the vacuum tank was 0.2 Torr, and the partial pressure of $H_2O$ in the atmosphere gas was 75%. The discharge frequency was 30 KHz, the output was 2,500 W, and the treating intensity was 0.5 kV.A.minute/m$^2$. Before the support was wound up after discharge treatment, it was brought into contact with a 50-cm diameter cooling roll equipped with a temperature controller so as to give a surface temperature of 30° C., followed by winding.

Then, subbing layers having the following composition were formed on both the surfaces of the support:

| Subbing Layer | |
|---|---|
| Deionized Alkali-Treated Gelatin (isoelectric point: 5.0) | 10.0 parts by weight |
| Water | 24.0 parts by weight |
| Methanol | 961.0 parts by weight |
| Salicylic Acid | 3.0 parts by weight |
| Polyamide-Epichlorohydrin Resin Described in Synthesis Example 1 of JP-A-51-3619 | 0.5 parts by weight |
| Nonionic Surfactant Compound I-13 Described in JP-B-3-27099 | 1.0 parts by weight |

This coating solution was applied in an amount of 10 ml/m$^2$ by use of a wire bar, and dried at 115° C. for 2 minutes, followed by winding.

Preparation of Silver Halide Photographic Materials

Preparation of Emulsion

Emulsion A was prepared by the following method:

Emulsion A

An aqueous solution of silver nitrate and an aqueous solution of halogen salts containing potassium bromide, sodium chloride, $K_3IrCl_6$ in an amount corresponding to $3.5\times10^{-7}$ mol per mol of silver and $K_2Rh(H_2O)Cl_5$ in an amount corresponding to $2.0\times10^{-7}$ mol per mol were added to an aqueous solution of gelatin containing sodium chloride and 1,3-dimethyl-2-imidazolidinethione, with stirring by the double jet method to prepare silver chlorobromide grains having a mean grain size of 0.25 μm and a silver chloride content of 70 mol %.

Thereafter, the grains were normally washed with water by the flocculation process, followed by addition of gelatin for dispersion. Further, 7 mg per mol of silver of sodium benzenethiosulfonate and 2 mg per mol of silver of benzenesulfinic acid were added, followed by adjustment to pH 6.0 and pAg 7.5. Then, 2 mg per mol of silver of sodium thiosulfate and 4 mg per mol of silver of chloroauric acid were added to conduct chemical sensitization at 60° C. so as to give optimum sensitivity. As a stabilizer, 150 mg of 4-hydroxy-6-methyl-1,3,3a,7-tetraazaindene was added, and 100 mg of Proxel was further added as a preservative. The resulting grains were cubic silver chlorobromide grains having a mean grain size of 0.25 μm and a silver chloride content of 70 mol % (fluctuation coefficient: 10%).

Preparation of Coated Samples

An UL layer (underlayer), an EM layer (emulsion layer), a PC layer (protective layer) and an OC layer (overcoat layer) were formed on the support in this order from the support side to prepare samples.

The preparation of each layer and the amount thereof coated are shown below:

UL Layer

Latex P-4 having active methylene groups in an amount of 30% by weight based on gelatin was added to an aqueous solution of gelatin, and the resulting solution was applied so as to give an amount of gelatin coated of 0.5 g/m$^2$.

EM Layer

To the above-mentioned emulsion A, the following compounds (S-1) and (S-2) each was added in an amount of $5\times10^{-4}$ mol per mol of silver as sensitizing dyes, and a mercapto compound represented by the following formula (a), a mercapto compound represented by the following formula (b), a triazine compound represented by the following formula (c), 5-chloro-8-hydroxyquinoline, the following compound (p) and the following compound (A) as a nucleating accelerator were added thereto in amounts of $3\times10^{-4}$ mol per mol of silver, $4\times10^{-4}$ mol per mol, $4\times10^{-4}$ mol per mol, $2\times10^{-3}$ mol per mol, $5\times10^{-4}$ mol per mol and $4\times10^{-4}$ mol per mol, respectively. Hydroquinone and N-oleyl-N-methyltaurine sodium salt were further added so as to give a coated amount of 100 mg/m$^2$ and 30 mg/m$^2$, respectively. Furthermore, a hydrazine derivative (compound No. 17), a watersoluble latex represented by the following formula (d), latex P-4 having active methylene groups, polyethylacrylate latex, colloidal silica having a mean grain size of 0.02 μm and sodium dodecylbenezenesulfonate were added so as to give amounts coated of $1\times10^{-5}$ mol/m$^2$, 200 mg/m$^2$, 200 mg/m$^2$, 200 mg/m$^2$, 200 mg/m$^2$ and 30 mg/m$^2$, respectively. 1,3-Divinylsulfonyl-2-propanol was further added as a hardener in an amount of 0.3 mmol/g based on the total amount of gelatin on one side. The pH of the solution was adjusted to 5.65 with acetic acid. The solution was applied so as to give a coated silver amount of 3.5 g/m$^2$.

The amount of gelatin was adjusted by changing the amount of gelatin for dispersion as shown in Table 1.

PC Layer

Gelatin (amounts shown in Table 1), an ethyl acrylate latex (125 mg/m$^2$), the following surfactant (w) (5 mg/m$^2$) and 1,5-dihydroxy-2-benzaldoxime (10 mg/m$^2$) were applied.

OC Layer

Gelatin (amounts shown in Table 1), an irregular $SiO_2$ matte agent having a mean grain size of about 3.5 μm (40 mg/m$^2$), methanol silica (0.1 g/m$^2$), polyacrylamide (100 mg/m$^2$), silicone oil (20 mg/m$^2$), a fluorine surfactant represented by the following structural formula (e) as a coating aid (5 mg/m$^2$) and sodium dodecylbenezenesulfonate (100 mg/m$^2$) were applied.

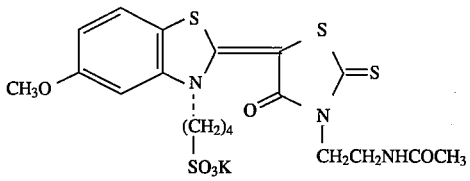
(S-1)

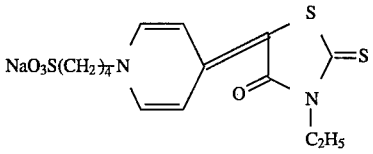
(S-2)

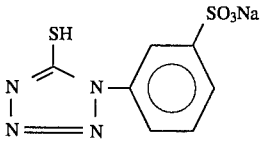
(a)

-continued

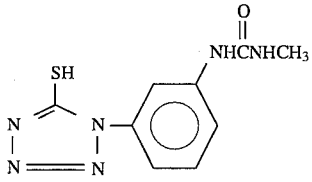
(b)

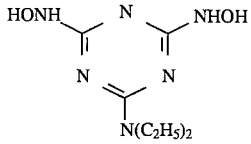
(c)

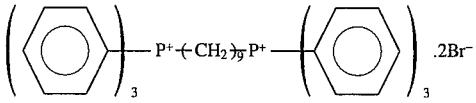
(A)

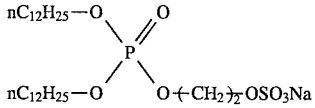
(p)

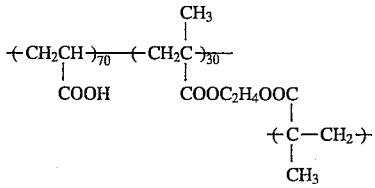
(d)

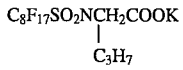
(e)

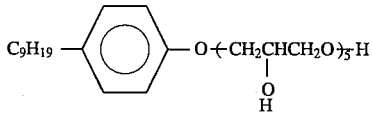
(w)

Each of these coated samples had a back layer and a back protective layer having the following compositions:

Formulation of Back Layer

| | |
|---|---|
| Gelatin | Amounts shown in Table 1 |
| Latex, Polyethyl Acrylate | 2 g/m$^2$ |
| Surfactant, Sodium p-Dodecylbenzenesulfonate | 40 mg/m$^2$ |
| $CH_2{=}CHSO_2CH_2CONH{-}$ $(CH_2)_2$ $CH_2{=}CHSO_2CH_2CONH{-}$ | 0.3 mmol/g of gelatin |
| $SnO_2$/Sb (weight ratio: 90/10, mean grain size: 0.20 μm) | 200 mg/m$^2$ |
| Dye, Mixture of Dye (a), Dye (b) and Dye (c) | |
| Dye (a) | 70 mg/m$^2$ |
| Dye (b) | 70 mg/m$^2$ |
| Dye (c) | 90 mg/m$^2$ |

Dye (a)

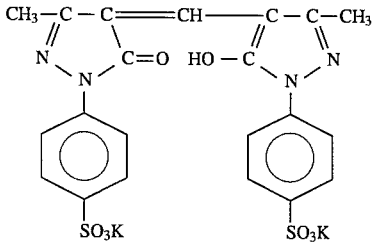

Dye (b)

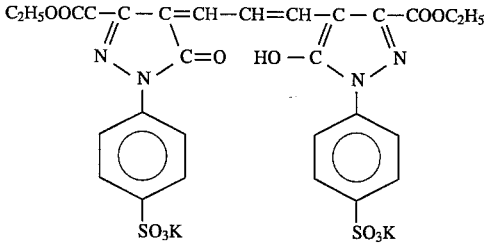

Dye (c)

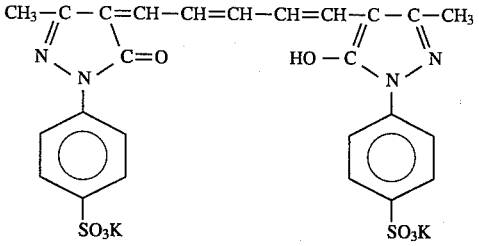

Back Protective Layer

| | |
|---|---|
| Gelatin | Amounts shown in Table 1 |
| Fine Polymethyl Methacrylate Grains (mean grain size: 4.5 μm) | 30 mg/m$^2$ |
| Sodium Dihexyl-α-sulfosuccinate | 15 mg/m$^2$ |
| Sodium p-Dodecylbenzenesulfonate | 15 mg/m$^2$ |
| Sodium Acetate | 40 mg/m$^2$ |

TABLE 1

| Sample No. | Amount of Gelatin Coated in Each Layer ($g/m^2$) Photosensitive Layer Side UL | EM | PC | OC | Total | Back Layer Side Back | Back Protective | Total |
|---|---|---|---|---|---|---|---|---|
| 1 | 0.5 | 1.6 | 0.5 | 0.5 | 3.1 | 2.9 | 0.8 | 3.7 |
| 2 | 0.5 | 1.3 | 0.5 | 0.5 | 2.8 | 2.7 | 0.7 | 3.4 |
| 3 | 0.5 | 1.2 | 0.5 | 0.3 | 2.5 | 2.4 | 0.6 | 3.0 |
| 4 | 0.5 | 0.9 | 0.5 | 0.3 | 2.2 | 2.3 | 0.5 | 2.8 |
| 5 | 0.5 | 0.7 | 0.5 | 0.2 | 1.9 | 2.0 | 0.4 | 2.4 |

Evaluation of Photographic Characteristics (1) Exposure and Development Processing The above-mentioned samples were exposed to xenon flash light having a light-emitting time of $10^{-5}$ second through an interference filter having a peak at 488 nm and a step wedge. The exposed samples were developed at 35° C. for 30 seconds using developing solutions A to D shown in Table 2, followed by fixing, washing and drying.

TABLE 2

| | Developing Solution-A (Invention) (g) | Developing Solution-B (Invention) (g) | Developing Solution-C (Comparison) (g) | Developing Solution-D (Comparison) (g) |
|---|---|---|---|---|
| Potassium hydroxide | 25.0 | 25.0 | 25.0 | 25.0 |
| Diethylenetriaminepentaacetic Acid | 2.0 | 2.0 | 2.0 | 2.0 |
| Potassium Carbonate | 42.0 | 42.0 | 42.0 | 42.0 |
| Sodium Metabisulfite | 20.0 | 20.0 | 40.0 | 40.0 |
| Potassium Bromide | 1.0 | 1.0 | 1.0 | 1.0 |
| Hydroquinone | — | — | 25.0 | 25.0 |
| Hydroquinone.Sodium Monosulfonate | 8.0 | 8.0 | — | — |
| 5-Methylbenzotriazole | 1.0 | 1.0 | 1.0 | 1.0 |
| N-methyl-p-aminophenol | 4.5 | — | 1.5 | 1.5 |
| Boric Acid | 12.0 | 12.0 | 12.0 | 12.0 |
| Sodium Erythorbate | 30.0 | 30.0 | — | 3.1 |
| 4-Hydroxymethyl-4-methyl-1-phenyl-3-pyrazolidone | — | 1.5 | — | — |
| Water was added to adjust the volume to 1 liter. | | | | |
| pH | 9.8 | 9.8 | 10.5 | 10.5 |

As a fixing solution, a solution having the following formulation was used.

| Formulation of Fixing Solution | |
|---|---|
| Ammonium Thiosulfate | 359.1 g |
| Disodium Ethylenediaminetetraacetate Dihydrate | 0.09 g |
| Sodium Thiosulfate Pentahydrate | 32.8 g |
| Sodium Sulfite | 64.8 g |
| NaOH | 37.2 g |
| Glacial Acetic Acid | 87.3 g |
| Tartaric Acid | 8.76 g |
| Sodium Gluconate | 6.6 g |
| Aluminum Sulfate | 25.3 g |
| pH (adjusted with sulfuric acid or sodium hydroxide) | 4.85 |
| Water to make | 3 liters |

TABLE 3

| Sample No. | Black Spot Fog Developing Solution A | B | C | D |
|---|---|---|---|---|
| 1 | 5 (Comparison) | 5 (Comparison) | 4 (Comparison) | 4 (Comparison) |
| 2 | 5 (Comparison) | 5 (Comparison) | 3 (Comparison) | 4 (Comparison) |
| 3 | 5 (Invention) | 4 (Invention) | 2 (Comparison) | 3 (Comparison) |
| 4 | 5 (Invention) | 4 (Invention) | 1 (Comparison) | 1 (Comparison) |
| 5 | 4 (Invention) | 4 (Invention) | 1 (Comparison) | 1 (Comparison) |

TABLE 4

| Sample No. | Dimensional Stability Deviation of Fourth Forme from First Forme |
|---|---|
| 1 (Comparison) | 25 μm |
| 2 (Comparison) | 18 μm |
| 3 (Invention) | 12 μm |
| 4 (Invention) | 10 μm |
| 5 (Invention) | 9 μm |

All the samples showed high contrast in all developing solutions A to D, and exhibited preferred characteristics as argon laser output photographic materials.

Evaluation of Black Spot Fog

The samples were developed by use of developing solutions A to D at 35° C. for 50 seconds. The black spot fog of unexposed portions was observed under a 25× magnifying glass. The case where no black spot was observed in a circle having a diameter of about 1 cm of the sample was taken as 5, the case where 100 or more black spots were observed was taken as 1, and intermediate evaluation therebetween was ranked as 2 to 4.

Results thereof are shown in Table 3. Use of developing solution A or B resulted in extremely reduced development of black spot fog, and even when the amount of gelatin on the photosensitive emulsion layer side was 2.5 g/m$^2$ or less, the rank was 4 or more. On the other hand, in the use of developing solution C or D, black spot fog was drastically deteriorated when the gelatin amount was decreased to 2.5 g/m$^2$ or less.

Evaluation of Dimensional Stability

Samples 1 to 5 were allowed to stand for 10 days after coating, followed by slitting and processing under conditions of 25° C. and 60% RH. Then, the samples were each exposed in a grid-like pattern continuously from the first forme to the fourth forme by use of a direct scanner graph SG-757 (manufactured by Dainippon Screen Mfg. Co., Ltd.), followed by development with an automatic processor FG-680AS (manufactured by Fuji Photo Film Co., Ltd.) charged with developing solution A. The width of deviation in the grid-like pattern from the first forme to the fourth forme was measured. As a result, the width of deviation was 12 μm or less per 61 cm of base length, when the amount of gelatin on the photosensitive emulsion layer side was 2.5 g/m$^2$ or less, resulting in very good register adjustment.

Exposure and development were conducted under an environmental condition of 25° C. and 40% RH.

For developing solution B, similar results were also obtained.

EXAMPLE 2

Preparation of Silver Halide photographic Materials

Preparation of Emulsion

Emulsion B was prepared by the following method.

Emulsion B

Emulsion B was prepared in the same manner as Emulsion A except that 1 mg/mol of silver of a selenium sensitizing agent represented by the following structural formula, 1 mg/mol of sodium thiosulfate and 4 mg/mol of chloroauric acid were added to conduct chemical sensitization at 60° C. so as to give optimum sensitivity.

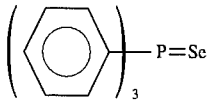

Preparation of Coated Samples

Sample was prepared in the same manner as Example 1 except that the following compound (S-3) was added in an amount of $2.1\times10^{-4}$ mol/mol of silver in place of the sensitizing dye used in the EM layer and that Emulsion B was used for the EM layer. Thus, a photographic material suitable for helium neon laser exposure was obtained.

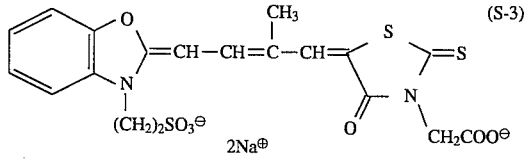

(S-3)

The black spot fog and the dimensional stability were evaluated in the same manner as Example 1, and results similar to those of Example 1 were obtained.

EXAMPLE 3

Preparation of Silver Halide Photographic Materials

Samples were prepared in the same manner as in Example 1 except that the sensitizing dye used in the EM layer was replaced by the following compound (S-4). Thus, a photographic material suitable for semiconductor laser exposure was obtained.

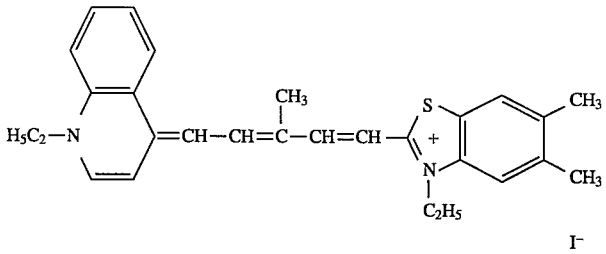

The black spot fog and the dimensional stability were evaluated in the same manner as in Example 1, and results similar to those of Example 1 were obtained.

While the invention has been described in detail with reference to specific embodiments, it will be apparent to one skilled in the art that various changes and modifications can be made to the invention without departing from its spirit and scope.

What is claimed is:

1. A method for forming a silver halide photographic image comprising developing a silver halide photographic material with a developing solution containing an ascorbic acid developing agent, substantially free from hydroquinone and having a pH of 8.5 to 11.0, said silver halide photographic material comprising a support which comprises a syndiotactic styrenic polymer and a silver halide emulsion layer provided on at least one surface of the support, said silver halide emulsion layer or another hydrophilic colloidal layer containing a hydrazine derivative, and the total amount of gelatin on the surface on which said silver halide emulsion layer is provided being 2.5 $g/m^2$ or less.

2. The method of claim 1, wherein the total amount of gelatin on the surface on which said silver halide emulsion layer is provided is from 1 $g/m^2$ to 2.2 $g/m^2$.

3. The method of claim 1, wherein the content of the hydrazine derivative is from $1.0\times10^{-6}$ to $5.0\times10^{-2}$ mol per mole of silver halide.

* * * * *